US008860630B2

(12) United States Patent
Kodama

(10) Patent No.: US 8,860,630 B2
(45) Date of Patent: Oct. 14, 2014

(54) ANTENNA APPARATUS AND METHOD FOR MANUFACTURING THE SAME

(75) Inventor: Katsuhisa Kodama, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 638 days.

(21) Appl. No.: 12/688,464

(22) Filed: Jan. 15, 2010

(65) Prior Publication Data

US 2011/0043409 A1 Feb. 24, 2011

(30) Foreign Application Priority Data

Aug. 19, 2009 (JP) ..... 2009-190017

(51) Int. Cl.
*H01Q 1/38* (2006.01)
*H01Q 21/00* (2006.01)
*H01Q 21/06* (2006.01)

(52) U.S. Cl.
CPC ..... *H01Q 21/064* (2013.01); *H01Q 21/0037* (2013.01)
USPC ..... 343/897; 343/770; 29/600

(58) Field of Classification Search
USPC ..... 343/700 MS, 778, 846, 770, 897; 29/600
See application file for complete search history.

(56) References Cited

U.S. PATENT DOCUMENTS

| | | | | |
|---|---|---|---|---|
| 3,016,002 | A | | 1/1962 | Frantz et al. |
| 3,153,145 | A | | 10/1964 | Yerkovich |
| 3,504,180 | A | | 3/1970 | Tone |
| 4,081,686 | A | | 3/1978 | Nieuweboer |
| 4,766,443 | A | * | 8/1988 | Winegard et al. ..... 343/840 |
| 4,990,926 | A | * | 2/1991 | Otsuka et al. ..... 343/700 MS |
| 2009/0315796 | A1 | | 12/2009 | Kodama |
| 2012/0038503 | A1 | | 2/2012 | Kodama |

FOREIGN PATENT DOCUMENTS

| | | | |
|---|---|---|---|
| DE | 1772040 | A | 12/1970 |
| DE | 2729660 | A1 | 8/1978 |
| DE | 4226428 | A1 | 2/1994 |
| DE | 102006041503 | A1 | 3/2008 |
| DE | 102007048873 | A1 | 12/2008 |
| DE | 102008056705 | A1 | 12/2009 |
| EP | 0584639 | B1 | 3/1994 |
| EP | 0632319 | A1 | 1/1995 |

(Continued)

OTHER PUBLICATIONS

Office Action dated Oct. 1, 2012, issued in the corresponding German Patent Application No. 102010004572.1.

(Continued)

*Primary Examiner* — Michael C Wimer
(74) *Attorney, Agent, or Firm* — Sughrue Mion, PLLC; Richard C. Turner

(57) ABSTRACT

First to third lamination layers as an antenna component part and a resilient plate material are laminated on a base, and are caulked by caulking members arranged on the base, so as to generate a planar antenna. The resilient plate material formed of a resilient material has a curved shape prior to assembly. Upon assembly, end portions are pressed and the resilient plate material is resiliently deformed into a flat plate. Due to the resilient force, the first to the third lamination layer are pressed against the base, and are caulked and fixed by the caulking members. Since the first to the third lamination layers are pressed due to the resilient force of the resilient plate material, the number of parts can be reduced and easy manufacturing can be achieved.

14 Claims, 18 Drawing Sheets

(56) References Cited

FOREIGN PATENT DOCUMENTS

| | | | |
|---|---|---|---|
| JP | 62110268 | A | 5/1987 |
| JP | 07-273536 | A | 10/1995 |
| JP | 11136024 | A | 5/1999 |
| JP | 2001156513 | A | 6/2001 |
| JP | 3356866 | B2 | 10/2002 |
| JP | 2005235713 | A | 9/2005 |
| WO | 9016010 | A | 12/1990 |
| WO | 2006104442 | A1 | 10/2006 |
| WO | 2008025572 | A1 | 3/2008 |

OTHER PUBLICATIONS

Japanese Office Action dated Aug. 6, 2013, issued in corresponding Japanese Patent Application No. 2009-190017.

Japanese Office Action dated May 28, 2013 issued in corresponding Japanese Patent Application No. 2009-190017.

* cited by examiner 103
85a
85
85b
85b
85a
84
83
82
81a
81

104
95a 95b
95
95b
95a
84

83

82

91a
91

104

515b
515
515a
515b
84

83

82
91a

91

ANTENNA APPARATUS AND METHOD FOR MANUFACTURING THE SAME

BACKGROUND OF THE INVENTION

1. Field of the Invention

The present invention relates to an antenna apparatus and a method for manufacturing the antenna apparatus.

2. Description of the Background Art

As a conventional antenna apparatus, there has been a tri-plate feed type planar antenna in which a tri-plate transmission line is used in order to enhance antenna efficiency and to achieve a low-loss feeding line. As a method for manufacturing such a tri-plate feed type planar antenna, the following manufacturing method has been proposed. That is, there is a method for manufacturing a tri-plate feed type planar antenna, in which a film substrate having a antenna circuit formed thereon is mounted on a surface of a ground conductor so as to provide a lower dielectric body interposed therebetween, and in which a slot board having a plurality of slot apertures is mounted on a surface of the film substrate such that an upper dielectric body is interposed therebetween, whereby the film substrate and the slot board are fixed. The method includes the steps of: arranging a seat portion on a desired position of the ground conductor so that the slot board and the ground conductor are held separated from each other by a predetermined distance; arranging holes which penetrate from the slot board through the seat portion; inserting rivets through the holes, thereby fixing the ground conductor and the slot board together by 之 caulking the rivets projecting upwardly from the slot board or downwardly from the ground conductor, or by press-fitting the rivets from above the slot board. Accordingly, it is possible to uniformly maintain a holding distance between the ground conductor and the slot board, and thus a tri-plate feed type planar antenna having a satisfactory antenna characteristic can be manufactured at a lower cost and in a shorter period of time than the conventional art (for example, see Paragraph [0009], and FIG. 1, FIG. 2 of Japanese Laid-Open Patent Publication No. 07-273536, hereinafter referred to as Patent document 1).

Since the conventional tri-plate feed type planar antenna is configured as described above, and is fixed by using the rivets, the number of parts is increased. Moreover, in order to prevent occurrence of gaps and distortion, and in order to reduce variation occuring in processing of the component parts, a sophisticated processing technique is required.

SUMMARY OF THE INVENTION

The present invention has been made to solve the above-described problems. An object of the present invention is to attain an antenna apparatus which has a reduced number of parts and which is easily manufacturable, and to provide a method for manufacturing a antenna apparatus which has a reduced number of parts and which is easily manufacturable.

An antenna apparatus according to the present invention is directed to an antenna apparatus including a base, an antenna component part, and a pressing plate, wherein the antenna component part includes a plurality of plate-like antenna lamination layers which are laminated one after another, the pressing plate is a plate formed of a resilient material, the pressing plate is arranged such that the antenna component part is interposed between the pressing plate and the base, and a fixing member which presses end portions of the pressing plate against the base is arranged, so that the pressing plate is resiliently deformed and that the antenna component part is pressed against the base due to a resilient force generated by the deformation.

Thus, it is possible to fix the antenna component part by using a simple structure, and also possible to allow reduction in the number of parts, and to obtain an easily manufacturable antenna apparatus.

A method for manufacturing the antenna apparatus according to the present invention includes a pressing plate arranging step of arranging a pressing plate such that an antenna component part, in which a plurality of plate-like antenna lamination layers are laminated one after another, is interposed between the pressing plate and a base, and a pressing plate fixing step of pressing the antenna component part against the base by using a resilient force generated by resiliently deforming the pressing plate, and pressing end portions of the pressing plate against the base by using a fixing member, so as to press against and fix to the base the antenna component part by using a resilient force generated by the resiliently deformed pressing plate.

Thus, it is possible to provide a method for manufacturing an antenna apparatus which has a reduced number of parts and which is easily manufacturabale.

The foregoing and other objects, features, aspects and advantages of the present invention will become more apparent from the following detailed description of the present invention when read in conjunction with the accompanying drawings.

DETAILED DESCRIPTION OF THE PREFERRED EMBODIMENTS OF THE INVENTION

First Embodiment

Figure 1A:
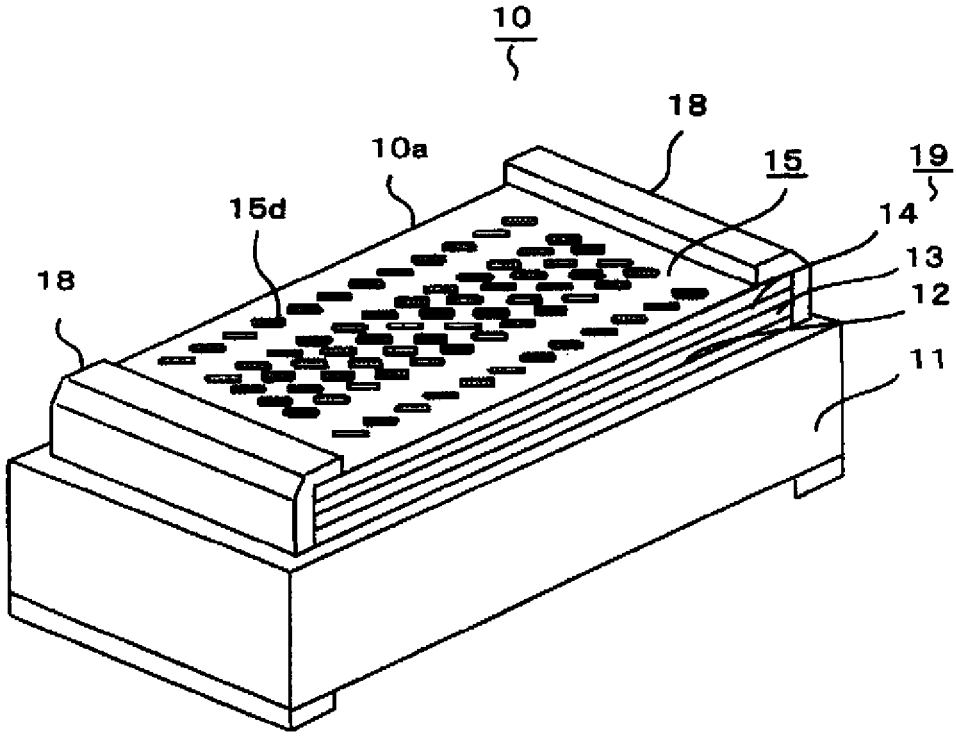
FIG. 1 is a perspective view of a planar antenna according to a first embodiment of the present invention.
Figure 1B:
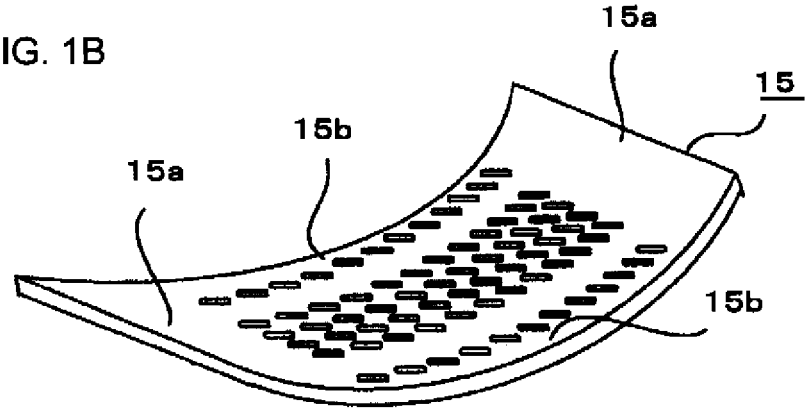

FIG. 1 to FIG. 3 show a first embodiment for implementing the present invention. FIG. 1A is a diagram showing a structure of a planar antenna, and FIG. 1B is a perspective view of a resilient plate material in a state prior to assembly. FIG. 2 is an exploded perspective view of the planar antenna, and FIG. 3 is a schematic diagram illustrating an assembly process. With reference to FIG. 1, an overall structure will be described. As shown FIG. 1A, a planar antenna 10, which is an antenna apparatus, is structured as follows. On a box-shaped base 11, a first lamination layer 12, a second lamination layer 13, and a third lamination layer 14, which are each of a plate shape and which form a plate-shaped antenna component part 19, and a resilient plate material 15, which is resiliently deformed into a flat plate, are laminated in close contact with each other. End portions of the first lamination layer 12, the second lamination layer 13, and the third lamination layer 14, and end portions 15*a* (described later in detail) of the resilient plate material 15, which is a pressing plate and which is resiliently deformed to a flat plate, are caulked along their nearly entire lengths by a caulking member 18 (described later in detail), which has been bent into an L-shape and which functions as a fixing member, a caulking member, and a locking member, and are fixed to the base 11 in an integrated manner. As shown in FIG. 1B, the resilient plate material 15 has a partially cylindrical shape having a curvature radius R until the resilient plate material 15 is deformed into a nearly flat plate (details to be described later). The resilient plate material 15 has a large number of opening portions 15*d* for emitting a radio wave, and a surface thereof forms an antenna aperture area 10*a*.

Next, with reference to FIG. 2, individual parts will be described in detail. As shown in FIG. 2C, the base 11 has a box shape having no bottom plate, and on a left and a right sides of its upper surface, plate members 17 are fixed in an opposed manner. A cross-section of each plate member 17 in a state prior to assembly has a rectangular shape. As shown in FIG. 2B, the first lamination layer 12, the second lamination layer 13, and the third lamination layer 14 each have a thin rectangular flat plate shape, and have formed therein a plurality of elongated slits 12*f*, 13*f*, and 14*f*, respectively. When the first lamination layer 12, the second lamination layer 13, and the third lamination layer 14 are laminated one after another, the slits 12*f*, 13*f*, and 14*f* are aligned in line, respectively, as viewed from a lamination direction, and waveguide tubes for allowing a radio wave to pass therethrough in the lamination direction are formed. The first lamination layer 12, the second lamination layer 13, and the third lamination layer 14 are, for example, formed of a stainless plate, or an aluminum plate.

Figure 2A:
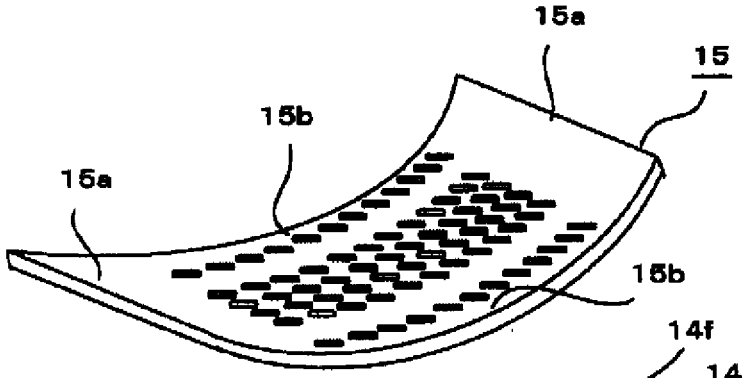
FIG. 2 is an exploded perspective view of the planar antenna according to the first embodiment.
Figure 2B:
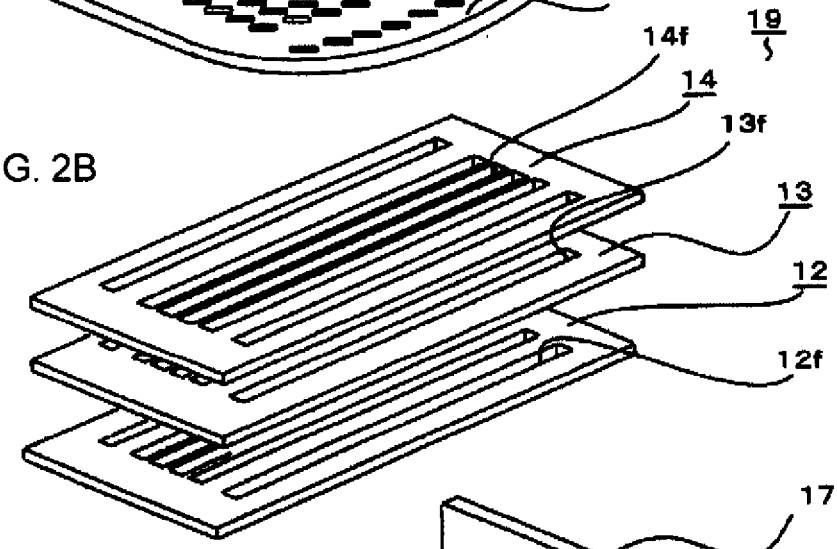
Figure 2C:
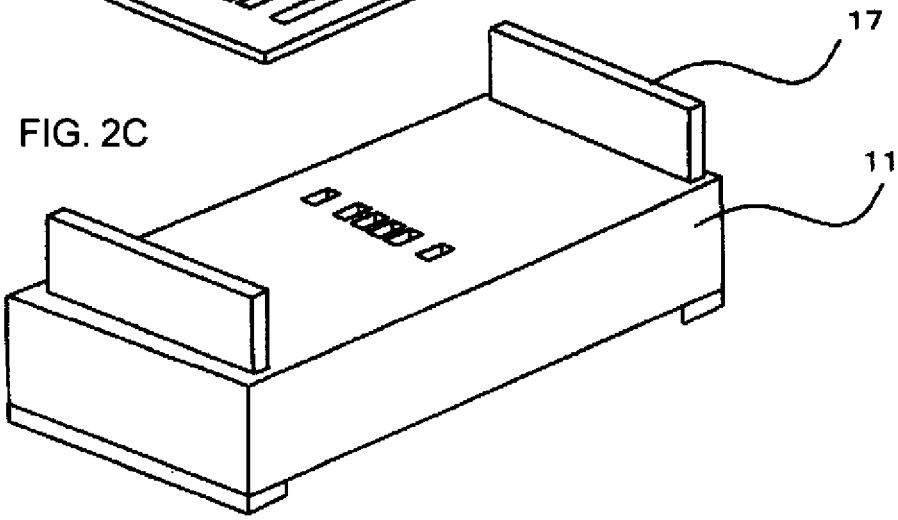

As shown in FIG. 2A, the resilient plate material 15 is in a form of a curved plate, prior to assembly, which is a plate-shaped resilient material having predetermined resilience and which has a curvature only in the upper direction in FIG. 2A. In this example, the resilient plate material 15 is formed in a curved plate of a partially cylindrical shape having a curvature satisfying formula (1) described later. The resilient plate material 15 has end portions 15*a* which are a pair opposing each other in a left-right direction in FIG. 2A, and which are linear ends formed in a circumferential direction of the partial cylinder, and also has end portions 15*b* which are a pair opposing each other in a depth direction in FIG. 2A and which are partially cylindrical ends formed in an axial direction. The resilient plate material 15 is formed of, for example, a stainless steel strip as a spring (e.g., SUS301-CSP, SUS304-CSP: JIS G 4313: 1996, or the like). Both of the end portions 15*a* of the resilient plate material 15 are pressed and resiliently deformed into a nearly flat plate as shown in FIG. 1A by the caulking member 18 (see FIG. 1A, details to be described later), and a spring force of the resilient plate material 15 fixes the third lamination layer 14, the second lamination layer 13, and the first lamination layer 12 while pressing substantially entire surfaces thereof against the base 11.

Figure 3A:
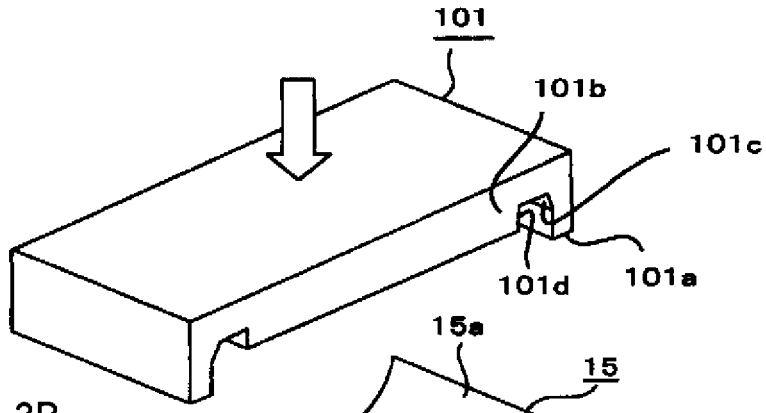
FIG. 3 is a schematic diagram illustrating a process of assembling the planar antenna according to the first embodiment.
Figure 3B:
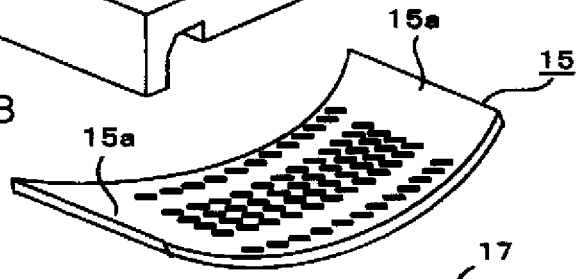
Figure 3C:
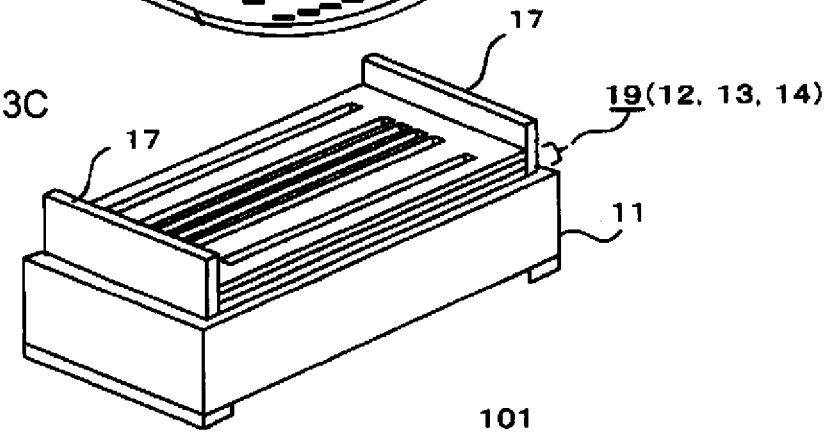

A procedure for assembling the above planar antenna 10 will be described with reference to FIG. 3. A caulking jig 101 is used for assembly, and as shown in FIG. 3A, the caulking jig 101 has abutting portions 101*a*, groove forming portions 101*b*, and shoulder portions 101*c* on each of the right and left sides in the diagram. The groove forming portions 101*b* form grooves 101*d* having a predetermined depth from the abutting portions 101*a*, and are engaged with the plate members 17. For assembly, the first lamination layer 12, the second lamination layer 13, and the third lamination layer 14 are laminated, in order, on an abutting surface of the base 11 such that the lamination layers are fitted into the plate members 17 which are fixed to the base 11 in advance, and consequently a state shown in FIG. 3C is generated. In this case, the positions of the respective slits 12*f*, 13*f*, and 14*f* are aligned in the lamination direction.

The resilient plate material 15 (FIG. 3B) is laid on the third lamination layer 14 so as to be convex downwardly. The above description indicates a process of arranging the pressing plate according to the present invention. The caulking jig 101 (FIG. 3A) is applied from above the resilient plate material 15, so as to cause the plate members 17 to be engaged with the groove forming portions 101*b*, and is pressed down until the abutting portions 101*a* abut against the base 11 (this is a process of jig pressing according to the present invention). In this case, the end portions 15*a* are pressed down, and the resilient plate material 15 turns into a nearly flat plate. In addition, the plate members 17 are bent inwardly by the shoulder portions 101*c* (FIG. 3A) of the caulking jig 101, and are plastic-deformed into caulking members 18 having an inverted L-shape. The caulking members 18 caulk and fix the end portions of the first lamination layer 12 to third lamination layer 14, and the end portions 15*a* of the resilient plate material 15. The above description is a process of fixing the pressing plate of the present invention. That is, the resilient plate material 15 is arranged such that the plate-shaped antenna component parts 19 are interposed between the resilient plate material 15 and the base 11, and nearly entire lengths of the end portions 15*a* of the resilient plate material 15 are pressed and fixed. The first lamination layer 12, the second lamination layer 13, and the third lamination layer 14 are pressed against and fixed to the base 11 by a spring force of the resilient plate material 15, and accordingly, the planar antenna 10 shown in FIG. 1 is manufactured.

The resilient plate material 15 is a curved plate having a curvature in one direction only, and the curved surface is, for example, formed so as to satisfy the following formula (1).

$$Y=16Y\max\cdot X(X^3-2L\cdot X^2+L^3)/(5L^4) \quad (1)$$

Wherein, Y: an amount of flexibility

X: position in a direction obtained by connecting between two fixed points on a plate member, Ymax: a maximum amount of flexibility, and L: distance between fixed points on the plate member.

Further, in order for contact pressure generated by pressing the resilient plate material 15 to be distributed uniformly, the end portions 15*a* which are ends opposing to each other in the circumferential direction are fixed by the caulking members 18, and a fixing force F applied per one side is set to be lesser than a force expressed by the following formula (2).

$$F=192Ebh^3Y\max/(60L^3) \quad (2)$$

Wherein, E: longitudinal resilient modulus of the plate member, b: length of a side of the end portion of the resilient plate material, the side not having a curvature, h: thickness of the resilient plate material, Ymax: maximum amount of flexibility (as above described), and L: distance between fixed points on the plate members (as above described).

After the resilient plate material 15, and the first lamination layer 12 to third lamination layer 14 are assembled onto the base 11, in order to uniformly keep an excitation phase of the antenna aperture area 10*a*, the resilient plate material 15 needs to be held (maintained) in a nearly flat plate state. As a result, the base 11 has a box shape such that a section modulus thereof is sufficiently greater than that of the resilient plate material 15. It is noted that in the case where a base having a thick plate shape is used instead of the base 11, or in the case where a material of the same type as the resilient plate material 15 is used for the base 11, the thickness of the base 11 needs to be sufficiently thicker than that of the resilient plate material 15, so as to secure sufficient rigidity. When the thickness of the resilient plate material 15 needs to be the same as that of the base 11, a strong material having a higher resilient modulus than the resilient plate material 15 is selected for the base 11.

In the above description, the first to the third lamination layers 12 to 14 and the resilient plate material 15 are caulked by the caulking members 18, which function as the fixing members, so as to be interposed between the caulking members 18 and the base 11, however, without limiting to this, fixing can be performed as follows. For example, instead of the caulking members 18, locking members originally processed into an L shape are prepared as the fixing members. The first to the third lamination layer 12 to 14 are laminated on the base 11, the resilient plate material 15 is then laid thereon in the same manner as described above, and the end portions 15*a* of the resilient plate material 15 are pressed by using a pressing jig (caulking function not required) similar to the above-described caulking jig 101 so as to cause the resilient plate material 15 to be a nearly flat plate. The end portions 15*a* of the resilient plate material 15 in a nearly flat state is locked by the locking members. In this case, the locking members are each bonded on the base 11 by using an adhesive agent, for example.

Figure 3D:
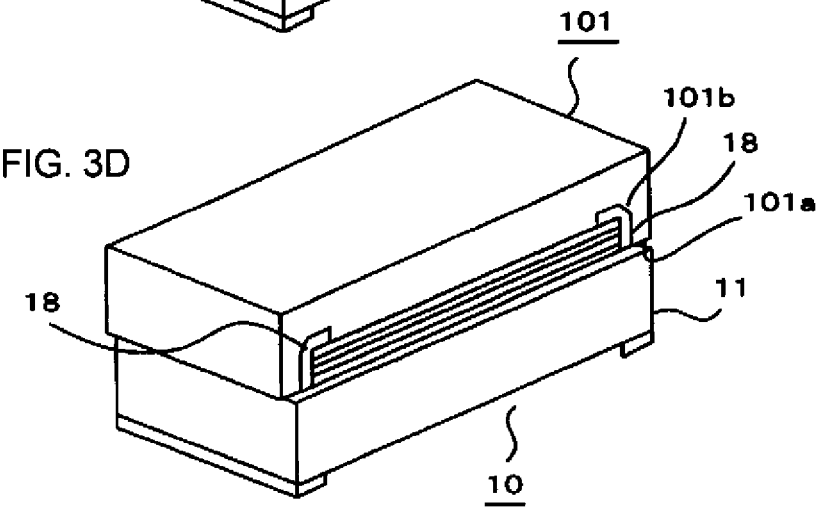
Figure 4A:
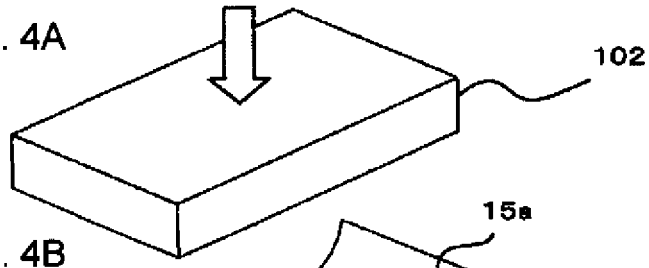
FIG. 4 is a schematic diagram illustrating a process of manufacturing a planar antenna according to a second embodiment.
Figure 4B:
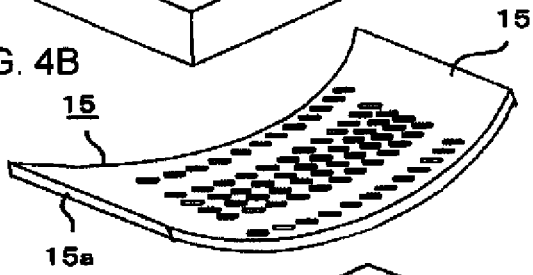
Figure 4C:
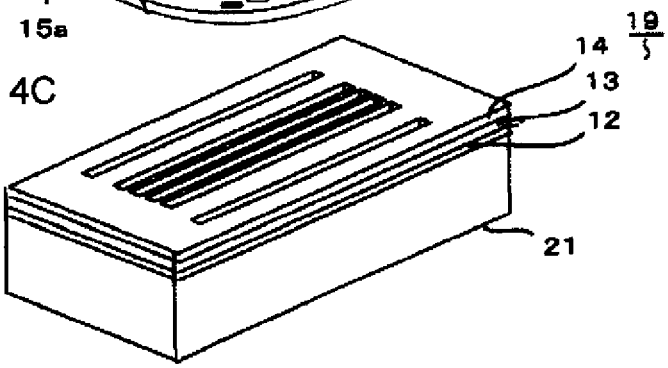
Figure 4D:
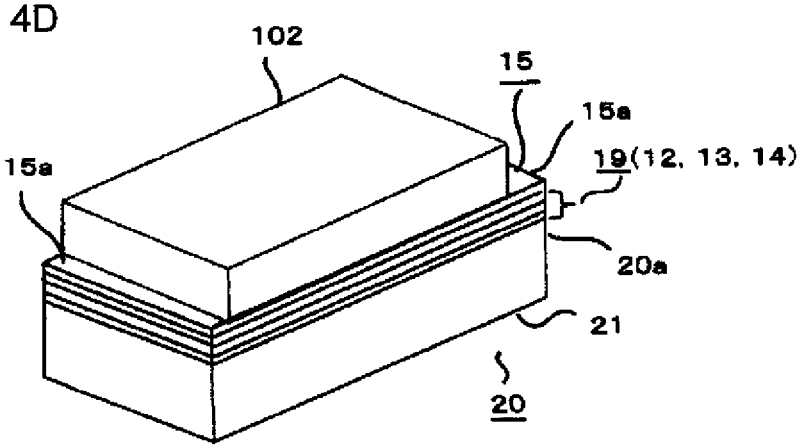

As described above, in the present embodiment, after fixing, the first lamination layer 12, the second lamination layer 13, and the third lamination layer 14 need to be fixed such that the contact pressure thereamong is uniform. Thus, the caulking jig 101 is used for caulking, since the crimping jig 101 is capable of fixing the resilient plate material 15 and the first lamination layer 12 to the third lamination layer 14, without applying an excess force thereto. As shown in FIG. 3D, the caulking jig 101 is formed such that when the resilient plate material 15 is pressed against the base 11 and turns into a nearly flat plate, the abutting portions 101*a* of the caulking jig 101 abut and rest on the base 11. As shown in FIG. 1A, after the plate members 17 are bent and fixed by caulking, the resilient plate material 15 on the uppermost part is resiliently deformed into a nearly flat plate shape. Thus, due to the spring force (restoring force), nearly entire surfaces of the first lamination layer 12 to the third lamination layer 14 are pressed against the base 11.

In addition, by using a reduced number of parts, it is possible to maintain waveguides and the antenna aperture area linearly without creating gaps, and thus it is possible to achieve uniformity in the excitation phase in the waveguides and in the antenna aperture area. Therefore, even if vibration or impact is applied to the first lamination layer 12 to the third lamination layer 14, or even in an environment where a temperature changes drastically, it is possible to maintain adherence among the first lamination layer 12 to the third lamination layer 14. In this manner, it is possible to fix an antenna component part with a simple structure. Thus, it is possible to attain a planar antenna which has a reduced number of parts and which is also easily manufacturable. In addition, according to the above-described manufacturing method, it is possible to provide a method for manufacturing a planar antenna which has a reduced number of parts and which is easily manufacturable.

Second Embodiment

Figure 5:
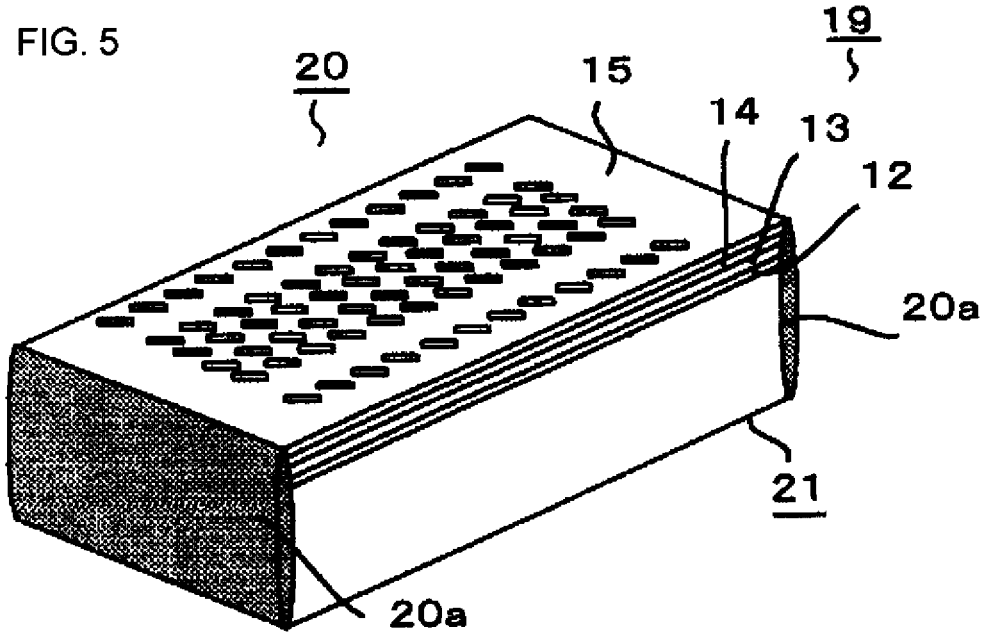
FIG. 5 is a perspective view of the planar antenna according to the second embodiment.
Figure 6:
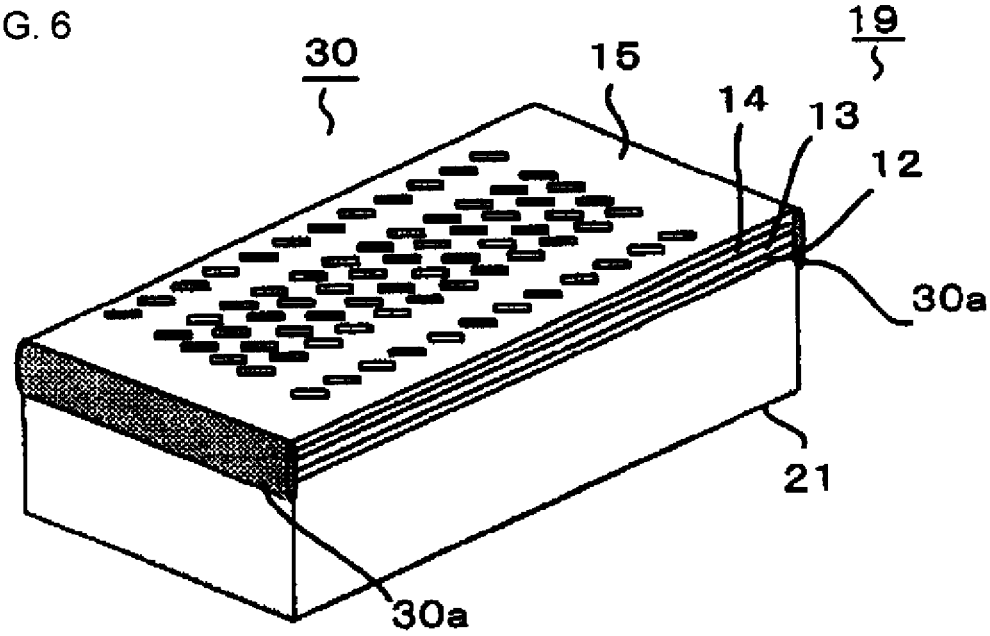
FIG. 6 is a perspective view of another planar antenna, which is a modified example of the planar antenna shown in FIG. 5.

FIG. 4 to FIG. 6 show a second embodiment. FIG. 4 is a schematic diagram illustrating a process of manufacturing a planar antenna, FIG. 5 is a perspective view of the planar antenna, and FIG. 6 is a perspective view of another planar antenna, which is a modified example of the planar antenna shown in FIG. 5. In the present embodiment, two end portions, of a resilient plate material, which are sides that do not have curvature are welded with end portions of a base, whereby lamination layers are integrated and fixed together. In FIG. 4, in the same manner as the first embodiment, a first lamination layer 12 to a third lamination layer 14 are mounted on a base 21 so as to be in a state shown in FIG. 4C, and a resilient plate material 15 (FIG. 4B) is laid on the uppermost part. Thereafter, by using a pressing jig 102 (FIG. 4A), the resilient plate material 15 on the uppermost part is pressed against the base 21 until the resilient plate material 15 turns into a nearly flat plate (FIG. 4D). In this state, end portions 15*a* of the resilient plate material 15, end portions of the first lamination layer 12 to the third lamination layer 14, and entire surfaces of end portions of the base 21 are fused to form end weld portions 20*a*, and are then welded and fixed together. Other than joining by using the above fuse welding, joining may be performed by welding using laser or the like, by brazing, by soldering or the like. FIG. 5 shows a planar antenna 20, which is an antenna apparatus having been fixed by fuse welding.

As a modified example, as shown in FIG. 6, the end portions of the base 21 are partially welded with end portions of the first lamination layer 12 to the third lamination layer 14 and with the end portions 15*a* of the resilient plate material 15 so as to form end weld portions 30*a* in an integrated manner, whereby a planar antenna 30 is structured as an antenna apparatus. In the planar antennas 20 and 30 of the present embodiment, in the same manner as the first embodiment, after fixing, nearly entire surfaces of the first lamination layer 12 to the third lamination layer 14 are pressed against the base 21 due to a resilient force of the resilient plate material 15. Thus, even if vibration or impact is applied to the first lamination layer 12 to the third lamination layer 14, or even in an environment where a temperature changes drastically, it is possible to maintain adherence among the base 21, and the first lamination layer 12 to the third lamination layer 14. Accordingly, it is possible to attain a planar antenna which has a reduced number of parts and which is easily manufacturable.

Third Embodiment

Figure 7A:
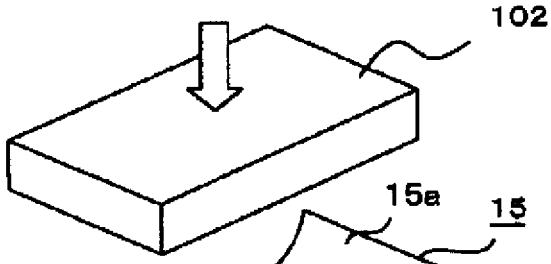
FIG. 7 is a schematic diagram illustrating a process of manufacturing a planar antenna according to a third embodiment.
Figure 7B:
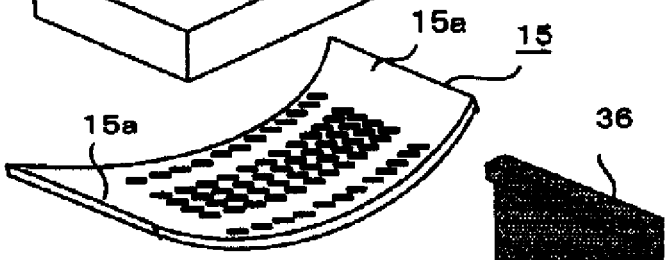
Figure 7C:
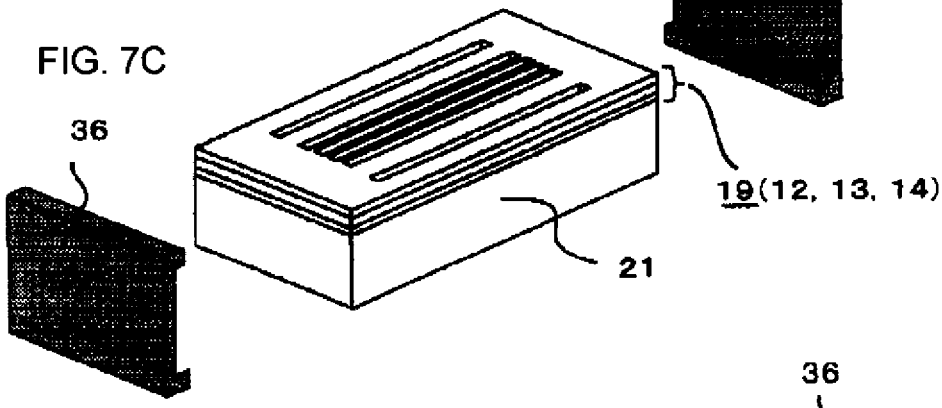
Figure 7D:
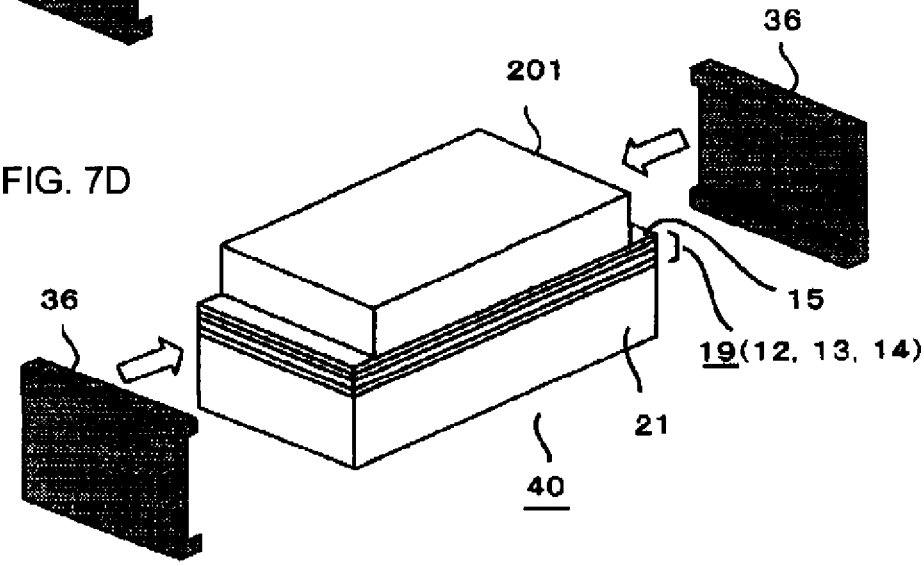
Figure 8:
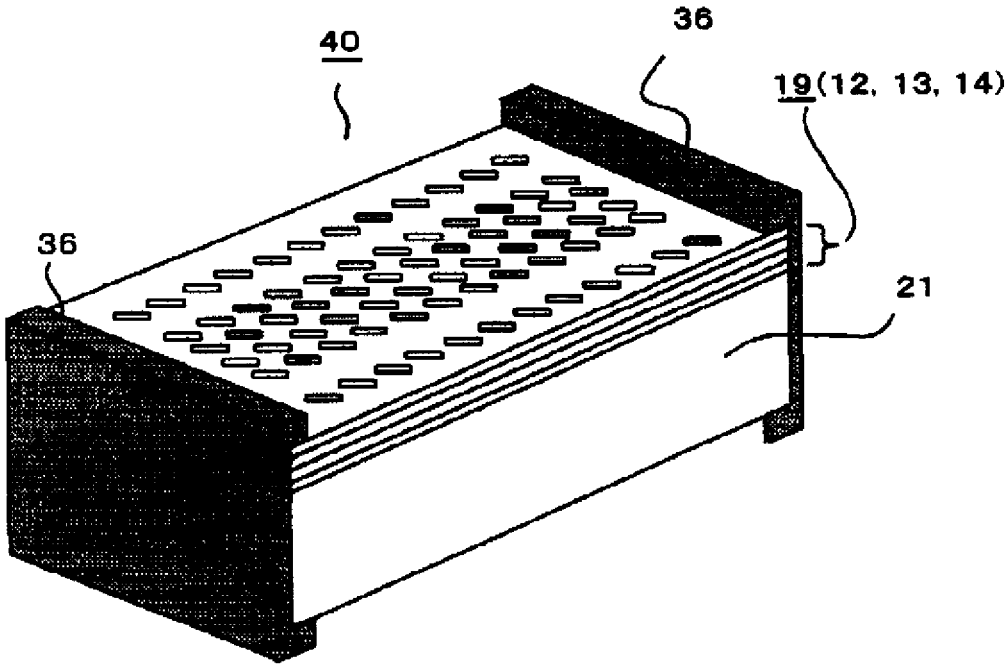
FIG. 8 is a perspective view of a planar antenna, according to the third embodiment, manufactured based on the manufacturing process shown in FIG. 7.

FIG. 7 and FIG. 8 show a third embodiment. FIG. 7 is a schematic diagram illustrating a process of manufacturing a planar antenna, and FIG. 8 is a perspective view of a planar antenna manufactured by the manufacturing process shown in FIG. 7. In the present embodiment, as shown in FIG. 7, end portions 15*a* of a resilient plate material 15 are press-fitted into clampers 36, which function as fixing members and gripping members, whereby a base 21, a first lamination layer 12 to a third lamination layer 14, and a resilient plate material 15 are fixed together in an integrated manner, and a planar antenna 40, as an antenna apparatus, is manufactured. In FIG. 7, the clampers 36 each have a shallow U-shape obtained by bending end portions short.

For the planar antenna 40, the first lamination layer 12 to the third lamination layer 14 (FIG. 7C) are laminated on a base 21, and the resilient plate material 15 (FIG. 7B) is laid on the top thereof, in the same manner as the first and the second embodiments. Thereafter, by using a pressing jig 102 (FIG. 7A), the resilient plate material 15 on the uppermost part is pressed against the base 21 until the resilient plate material 15 turns into a nearly flat plate (FIG. 7D). End portions 15*a* of the resilient plate material 15 and end portions of the first lamination layer 12 to third lamination layer 14 and base 21 are press-fitted into clampers 36, and clamped and fixed in an interference-fit manner. The planar antenna 40 manufactured in this manner is shown in FIG. 8.

In the above-described planar antenna 40 as well, in the same manner as the first and the second embodiments, after fixing, nearly entire surfaces of the first lamination layer 12 to the third lamination layer 14 are pressed against the base 21 due to a resilient force of the resilient plate material 15. Thus, as with the first embodiment, even if vibration or impact is applied to the base 21, and the first lamination layer 12 to the third lamination layer 14, or even in an environment where a temperature changes drastically, it is possible to maintain adherence among the base 21, and the first lamination layer 12 to the third lamination layer 14. Accordingly, it is possible to attain a planar antenna which has a reduced number of parts and which is easily manufacturable.

Fourth Embodiment

Figure 9A:
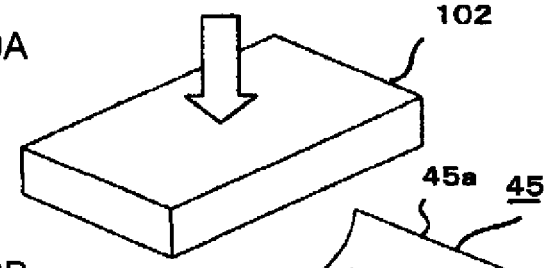
FIG. 9 is a schematic diagram illustrating a process of manufacturing a planar antenna according to a fourth embodiment.
Figure 9B:
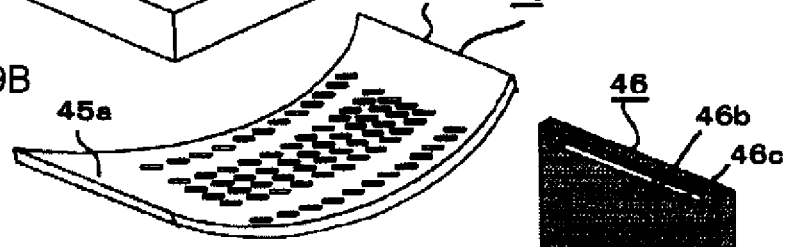
Figure 9C:
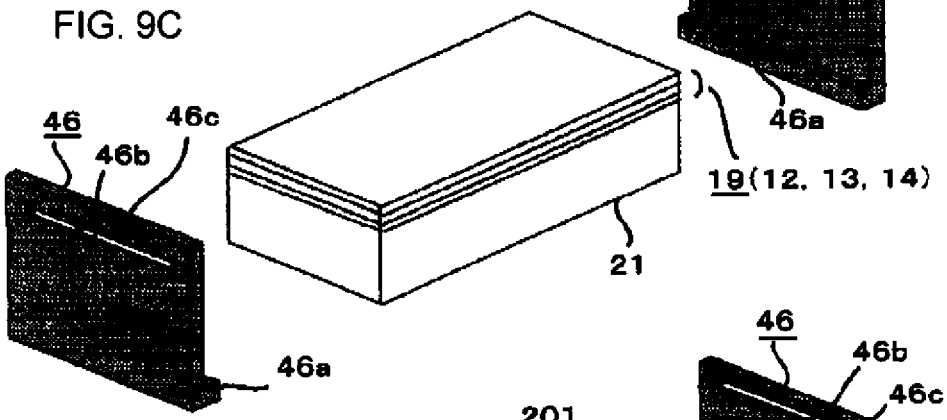
Figure 9D:
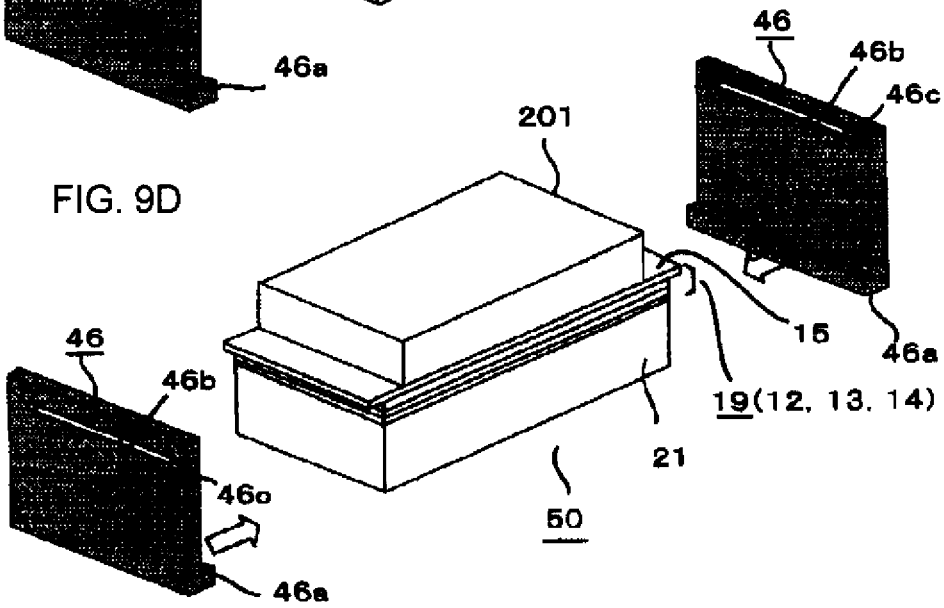
Figure 10:
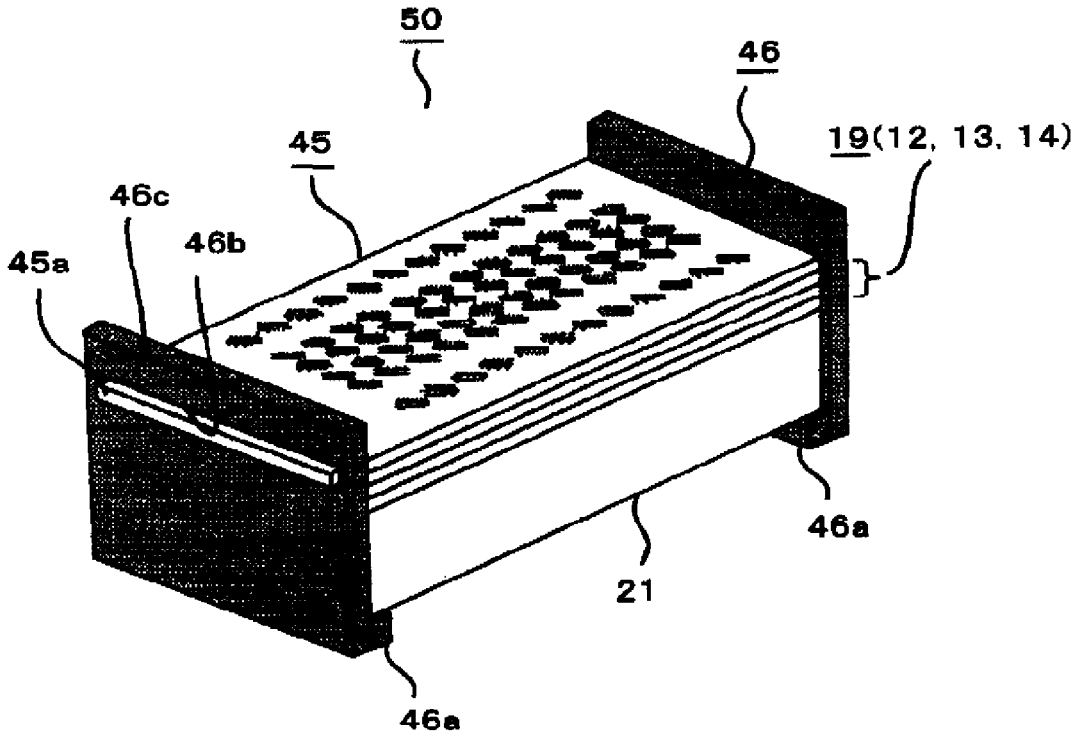
FIG. 10 is a perspective view of the planar antenna, according to the fourth embodiment, manufactured based on the manufacturing process shown in FIG. 9.

FIG. 9 and FIG. 10 show a fourth embodiment. FIG. 9 is a schematic diagram showing a process of manufacturing a planar antenna, and FIG. 10 is a perspective view of the planar antenna manufactured by using the manufacturing process shown in FIG. 9. As shown in FIG. 9C, locking members 46, which each have a bent lower end portion 46*a* and which each have a slit forming portion 46*c* which is located on an upper portion and forms a slit 46*b*, are used as fixing members and as locking members, whereby fixing may be performed. For a planar antenna 50, which is an antenna apparatus, first, the first lamination layer 12 to the third lamination layer 14 (FIG. 9C) are laminated on the base 21, and a resilient plate material 45 (FIG. 9B) is laid on the top thereof. In this case, the resilient plate material 45 is almost the same as the resilient plate material 15 shown in FIG. 1, however, the length of end portions 45*a*, which are a pair of end portions arranged in a left-right direction, that is, in a circumferential direction in FIG. 9, is slightly longer than the end portions of the resilient plate material 15. This is because the end portions 45*a* are engaged with the slit forming portions 46*c* of the locking members 46 to be described later.

After the resilient plate material 45 is laid on the third lamination layer 14, the resilient plate material 45 on the uppermost part is pressed against the base 21 by using the pressing jig 102 (FIG. 9A) until the resilient plate material 45 turns into a nearly flat plate (FIG. 9D). Then the end portions 46*a* of the locking members 46 engage with end portions of the base 21, and at the same time, the end portions 45*a* of the resilient plate material 45 pressed to be a flat plate are engaged with the slit forming portions 46*c* of the locking members 46, whereby the first lamination layer 12 to the resilient plate material are fixed to the base 21. FIG. 10 shows the planar antenna 50 manufactured in this manner.

In the above-described planar antenna 50 as well, in the same manner as the first and the second embodiments, after fixing, nearly entire surfaces of the first lamination layer 12 to the third lamination layer 14 are pressed against the base 21 due to a resilient force of the resilient plate material 45. Thus, as with the first embodiment, even if vibration or impact is applied to the base 21, and the first lamination layer 12 to the third lamination layer 14, or even in an environment where a temperature changes drastically, it is possible to maintain adherence among the base 21, and the first lamination layer 12 to the third lamination layer 14. Accordingly, it is possible to attain a planar antenna which has a reduced number of parts and which is easily manufacturable.

Fifth Embodiment

Figure 11A:
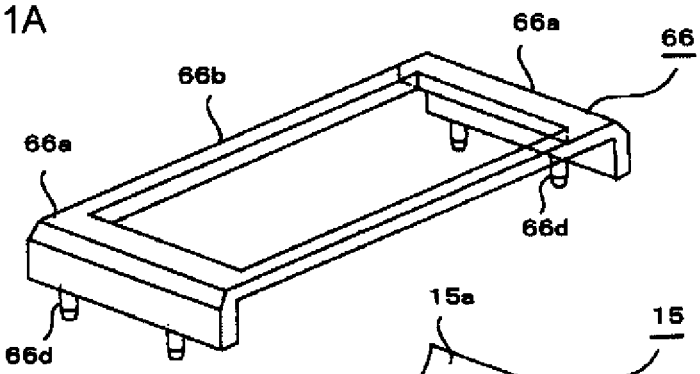
FIG. 11 is a perspective view of a planar antenna according to a fifth embodiment.
Figure 11B:
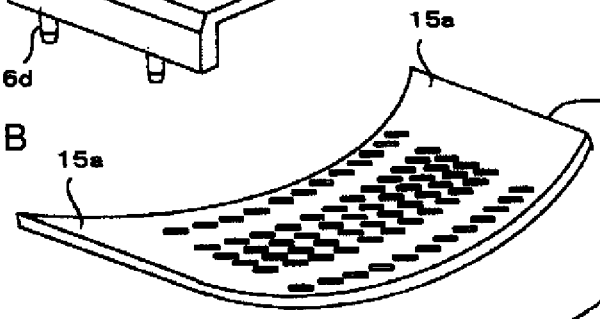
Figure 11C:
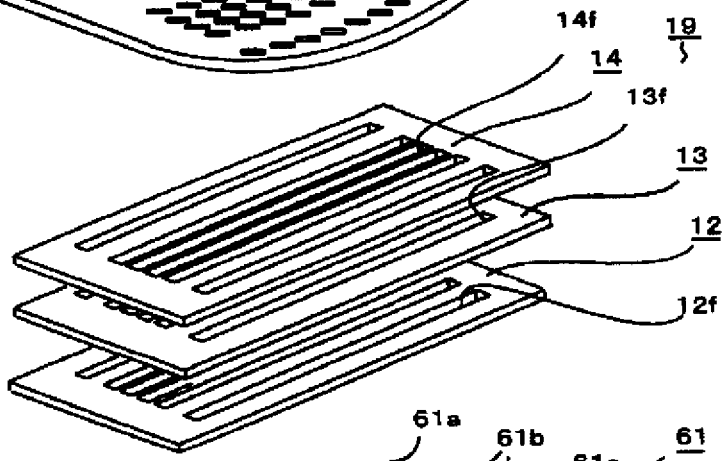
Figure 11D:
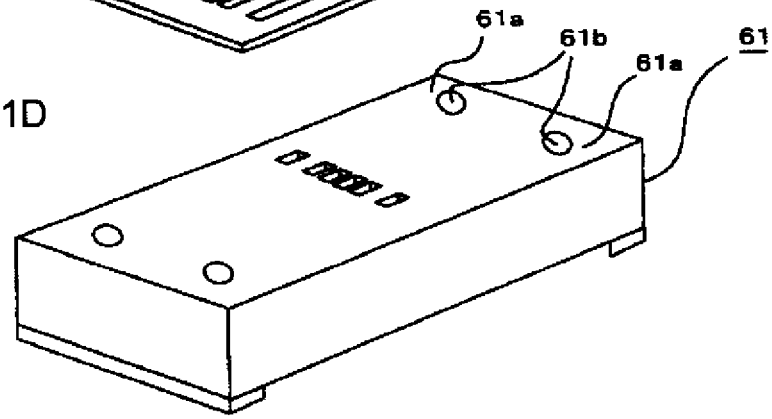
Figure 12:
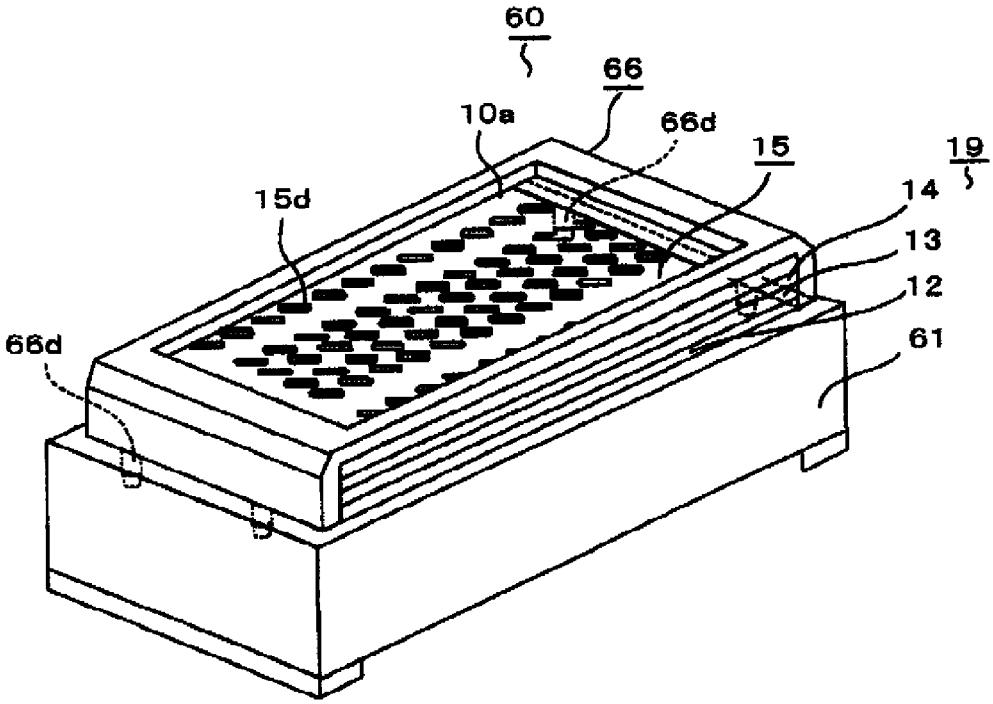
FIG. 12 is a schematic diagram illustrating a process of manufacturing the planar antenna according to the fifth embodiment.

FIG. 11 and FIG. 12 show a fifth embodiment. FIG. 11 is a schematic diagram showing a process of manufacturing a planar antenna, and FIG. 12 is a perspective view of the planar antenna. In the present embodiment, the structures of a base 61 and a fixing frame 66, which functions as a fixing member and a locking member, are different from those described in the above respective embodiments. As shown in FIG. 11D, the base 61 is similar to the base 11 according to the first embodiment shown in FIG. 2C, in that the base 61 has a shape of a box which has no lid and which is arranged upside down. However, the base 61 is different therefrom in that two fitting holes 61*b* are formed in fitting holes forming portions 61*a* in the vicinity of both left and right ends of the base 61.

Further, as shown in FIG. 11A, the fixing frame 66 has pressing portions 66*a*, connecting portions 66*b*, and fitting pins 66*d*. A pair of the pressing portions 66*a* in the left and right is formed in an L-shape, and a pair of the connecting portions 66*b* is connected with the end portions of the pressing portions 66*a* in their longitudinal direction (a depth direction in FIG. 11A) to form a rectangular frame. Two holes, which are not shown, are formed in the bottom of each of the pressing portions 66*a*, and one end of the respective fitting pins 66*d* is press-fitted into the holes (not shown) in an interference-fit manner. The other end, that is, a lower end of each fitting pin 66*d* is processed in a taper shape.

For a planar antenna 60, which is an antenna apparatus, first, a first lamination layer 12 to a third lamination layer 14 (FIG. 11C) are laminated on the base 61, and the resilient plate material 15 (FIG. 11B) is laid on the top thereof, in the same manner as the first embodiment. Further, the fixing frame 66 is laid on the top thereof. To lay the fixing frame 66, positions of the fitting pins 66*d* are aligned with positions of fitting holes 61*b* in the base 61. Then, by using a pressing jig similar to the pressing jig 102 shown in FIG. 7, the resilient plate material 15 is pressed, via the fixing frame 66 on the uppermost part, against the base 61 (FIG. 11D) until the resilient plate material 15 turns into a nearly flat plate. At the same time, the fitting pins 66*d* are press-fitted into the fitting holes 61*b* in the base 61 such that the fitting pins 66*d* are fitted into the fitting hole forming portions 61*a* in an interference-fit manner.

Accordingly, on the box-shaped base 61, the first lamination layer 12, the second lamination layer 13, the third lamination layer 14, which form an antenna component part 19, and the resilient plate material 15 are laminated in close contact with one another, and due to a resilient force of the resiliently deformed resilient plate material 15, nearly entire surfaces of the first lamination layer 12, the second lamination layer 13, and the third lamination layer 14 are pressed against the base 11.

In this case, since the first lamination layer 12 to the third lamination layer 14, and the resilient plate material 15 are pressed by the fixing frame 66 in a secured manner, a vertical height (length in a up-down direction in FIG. 11A) of each pressing portion 66*a* is set slightly shorter than a total thickness of the first lamination layer 12 to the third lamination layer 14 and the resilient plate material 15. By setting the height shorter in this manner, the pressing portion 66*a* is sufficiently pressed down, and the fitting pins 66*d* and the fitting hole forming portions 61*a* are engaged with each other while end portions of the first lamination layer 12 to the third lamination layer 14 and the resilient plate material 15 are pressed down in a secured manner. Therefore, it is possible to fix the first lamination layer 12 to the third lamination layer 14 and the resilient plate material 15 to the base 61 in a secured manner. FIG. 12 shows the planar antenna 60 manufactured in this manner.

Although described above is an example where the fitting pins 66*d* are inserted into the fitting holes in the fixing frame 66, fitting pins may be inserted into fitting holes arranged in the base.

Sixth Embodiment

Figure 13:
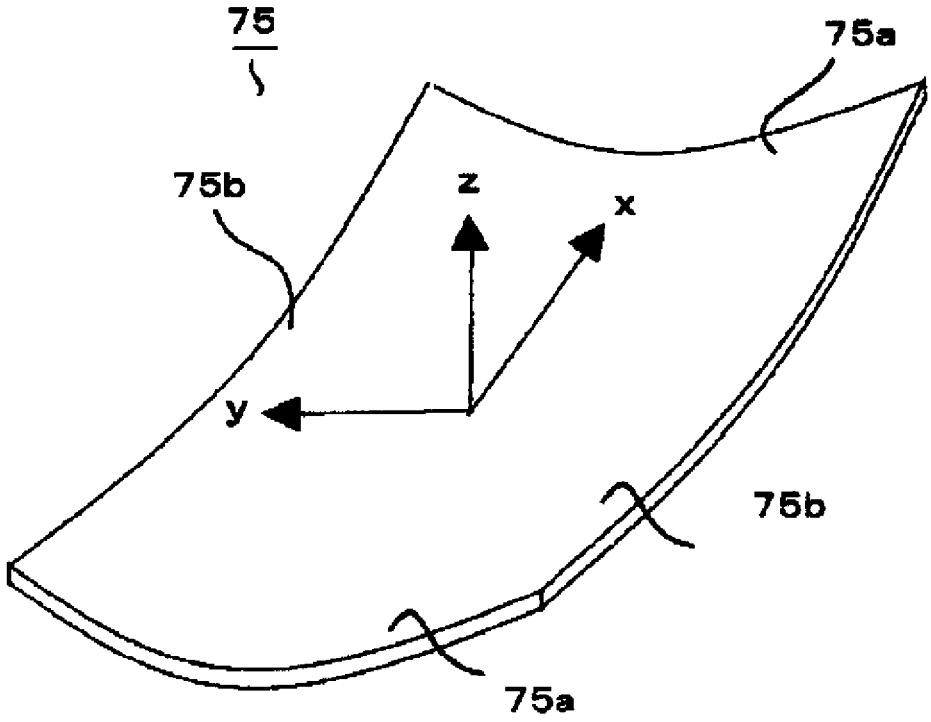
FIG. 13 is a perspective view of a resilient plate material according to a sixth embodiment.

FIG. 13 is a perspective view of a resilient plate material according to a sixth embodiment. In FIG. 13, a resilient plate material 75, which functions as a pressing plate, is formed of a plate-like resilient material prior to assembly, and also has a cupule-like curved surface having curvatures in a long-side direction and in a short-side direction. That is, the resilient plate material 75 is formed in a partial spherical shape having curvatures in an x-direction and a y-direction in an xyz three-dimensional coordinate system, and has end portions 75*a*, along the x-direction, which are a pair of end portions on the short-side, and has end portions 75*b*, along the y-direction, which are a pair of end portions on the long-side and are perpendicular to the end portions 75*a* on the short-side. The resilient plate material 75 is manufactured of a stainless steel strip as a spring in the same manner as the resilient plate material 15 shown in FIG. 1, for example. The resilient plate material 75 as described above can be used instead of the resilient plate material 15 shown in FIG. 1, FIG. 3, FIG. 4, FIG. 7, and FIG. 11. The end portions 75*a* of the resilient plate material 75 having the partial spherical shape is pressed along their nearly entire lengths until the resilient plate material 75 turns into a nearly flat plate, and are fixed to the base 11 (FIG. 1A), the base 21 (FIG. 4D), the base 61 (FIG. 11D), or the like in the same manner as each of the above embodiments.

Seventh Embodiment

Figures 14A, 14B, 14C, 14D, 14E, 14F:
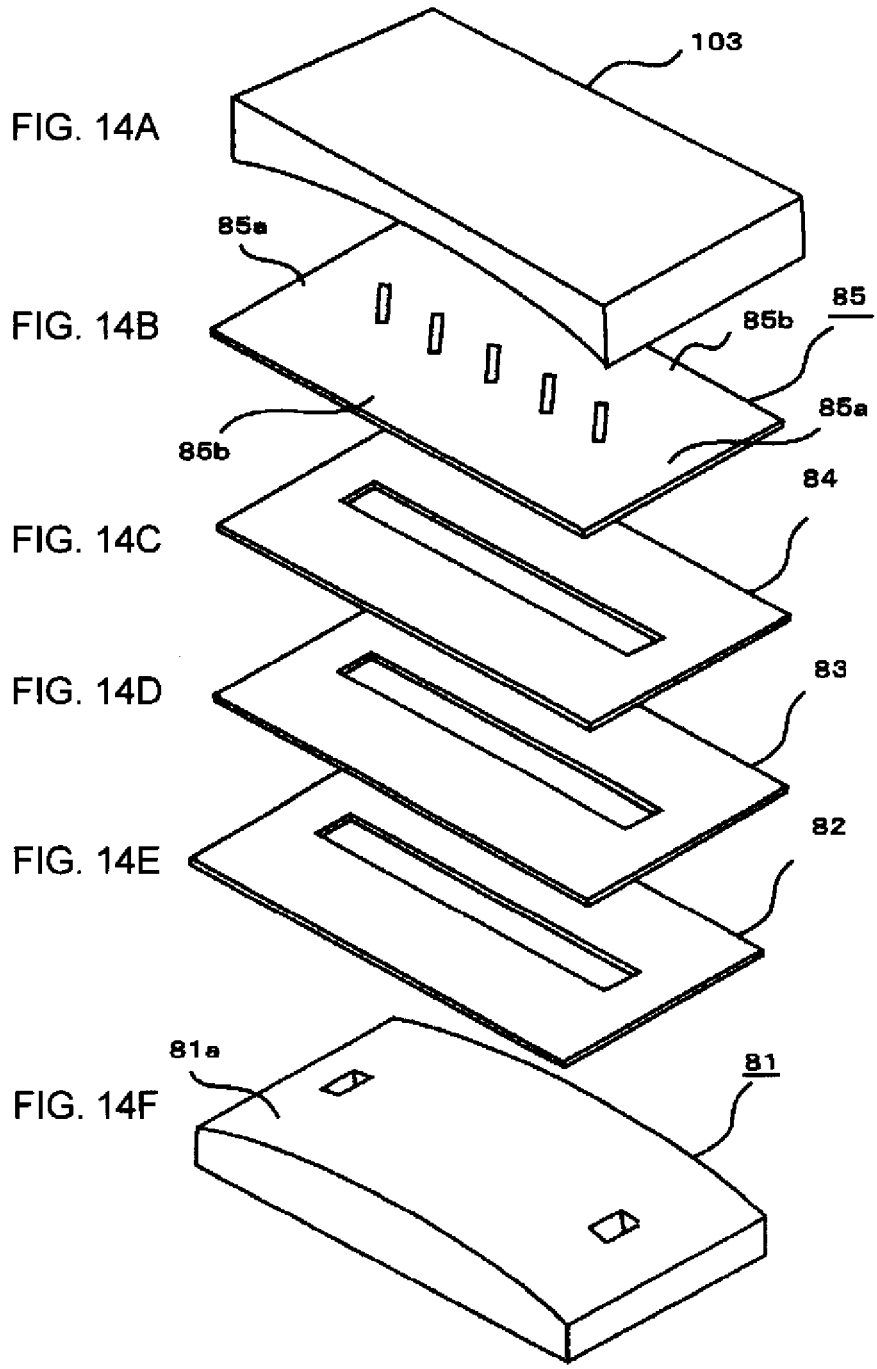
FIG. 14 is a schematic diagram illustrating a process of manufacturing a curved-surface antenna according to a seventh embodiment.
Figure 15:
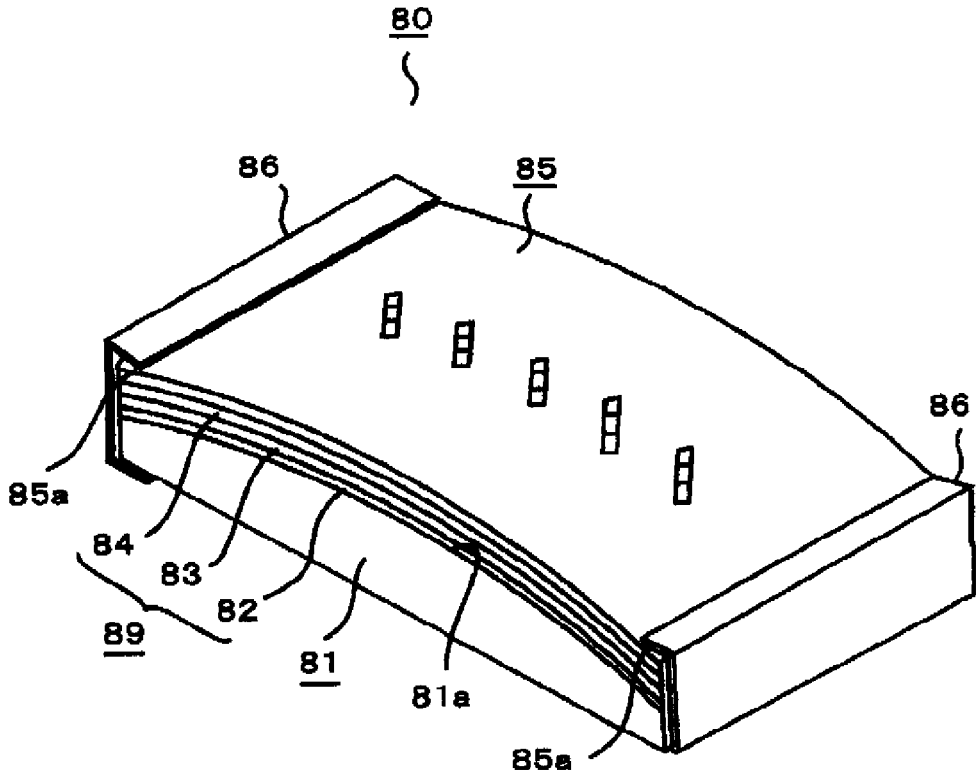
FIG. 15 is a perspective view of the curved-surface antenna according to the seventh embodiment.

FIG. 14 and FIG. 15 show a seventh embodiment. FIG. 14 is a schematic diagram showing a process of manufacturing a curved-surface antenna, and FIG. 15 is a perspective view of the curved-surface antenna. First, with reference to FIG. 14, a method for manufacturing a curved-surface antenna 80, which is an antenna apparatus, will be described. Prior to the description, component parts shown in FIG. 14 will be described in order from bottom to top. As shown in FIG. 14F, a box-shaped base 81 has a convex portion 81*a* which is upwardly convex and has a partially cylindrical shape having a curvature in one direction. As shown in FIG. 14E, a first lamination layer 82 is a rectangular flat plate. As shown in FIG. 14D, a second lamination layer 83 is a rectangular flat plate, as with the first lamination layer 82. As shown in FIG. 14C, a third lamination layer 84 is the same as the first lamination layer 82 and is a rectangular flat plate. As shown in FIG. 14B, a resilient plate 85, which is a flat plate and which functions as a pressing plate, has end portions 85*a*, which are a pair of opposing end portions on the short-side of the resilient plate 85, and end portions 85*b*, which are a pair of opposing end portions on the long-side thereof. The resilient plate 85 is manufactured, for example, of a stainless steel strip as a spring in the same manner as the resilient plate material 15 shown in FIG. 1. As shown in FIG. 14A, a pressing jig 103 has a concave pressing portion 103a which has a concave central portion and which has a partially cylindrical shape having a curvature in one direction.

In the same manner as the sixth embodiment, in FIG. 14, for the curved-surface antenna 80, first, the first lamination layer 82, the second lamination layer 83, and the third lamination layer 84 are laminated on the convex portion 81*a* of the box-shaped base 81, and a resilient plate 85 is laid on the top thereof. In this state, the first lamination layer 82, the second lamination layer 83, the third lamination layer 84, and the resilient plate 85 are each in a flat plate state. Thereafter, by using the pressing jig 103 (FIG. 14A) having a downwardly concave curved surface, the resilient plate 85 located at the uppermost part is pressed, and the resilient plate 85, the third lamination layer 84, the second lamination layer 83, and the first lamination layer 82 are resiliently deformed and pressed against the convex portion 81*a* of the base 81 (FIG. 15). The end portions 85*a* of the resilient plate 85, end portions of the first lamination layer 82 to the third lamination layer 84, and end portions of the base 81 are press-fitted into clampers 86 which function as fixing members and gripping members, and clamped and fixed in an interference-fit manner. FIG. 15 shows the curved-surface antenna 80 which is an antenna apparatus manufactured as above.

In FIG. 15, the curved-surface antenna 80, which is the antenna apparatus, is structured as follows. The first lamination layer 82, which forms an antenna component part 89, and is resiliently deformed from a flat plate shape to a curved plate shape, abuts against the convex portion 81*a*, which is an abutting portion of the box-shaped base 81, and the second lamination layer 83, the third lamination layer 84, and the resilient plate 85, which are each resiliently deformed from a flat plate shape to a curved shape, are laminated on the first lamination layer 82 so as to be in close contact with one another. Due to the resilient force generated by the resiliently deformed resilient plate 85, the first lamination layer 82, the second lamination layer 83, and the third lamination layer 84 are pressed against the base 81, and come into close contact with one another. Respective end portions of the base 81 and end portions of the antenna component part 89 and resilient plate 85 mounted on the base 81 are integrally fixed with each other by using the U-shaped clampers 86 in an interference-fit manner.

Eighth Embodiment

Figures 16A, 16B, 16C, 16D, 16E, 16F:
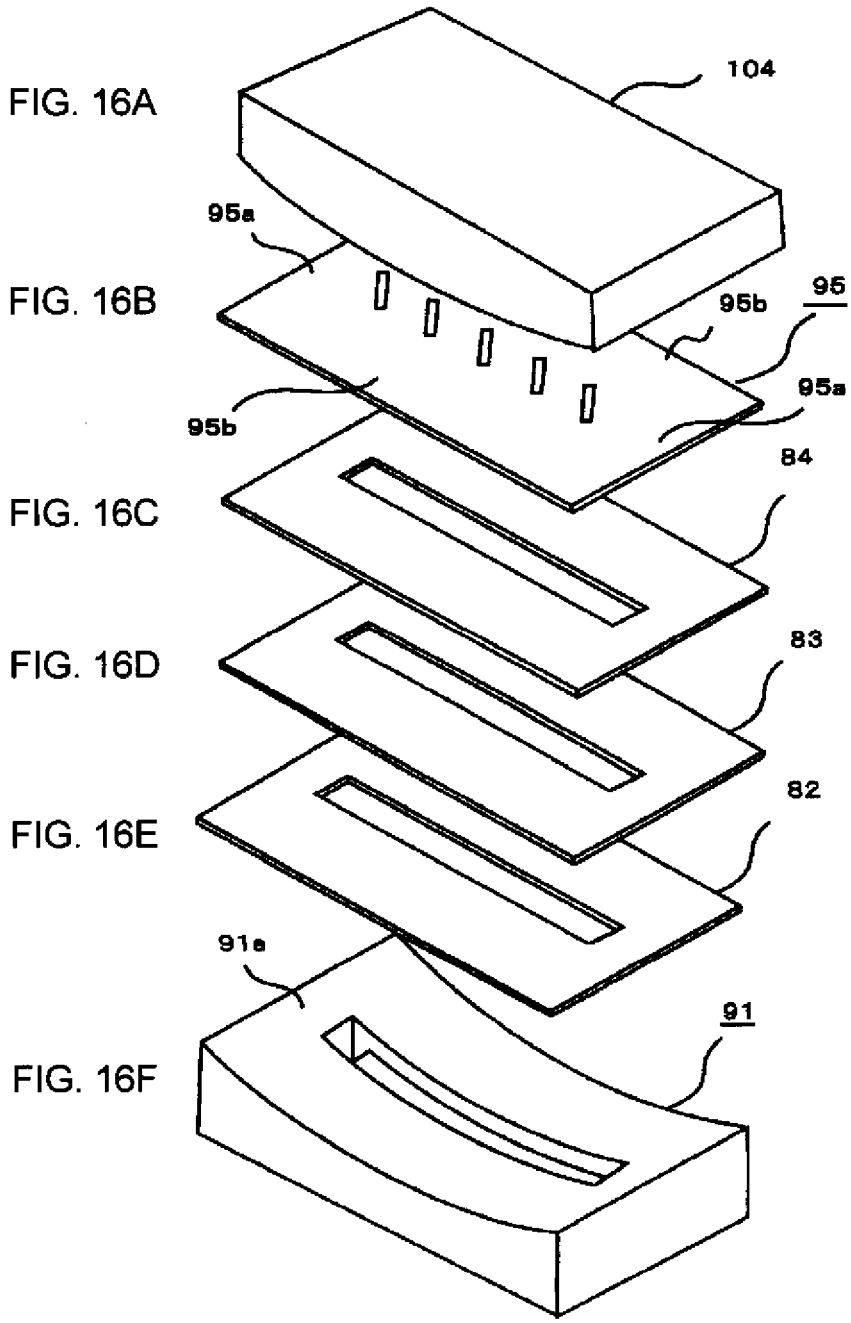
FIG. 16 is a schematic diagram illustrating a process of manufacturing a curved-surface antenna according to an eighth embodiment.
Figure 17:
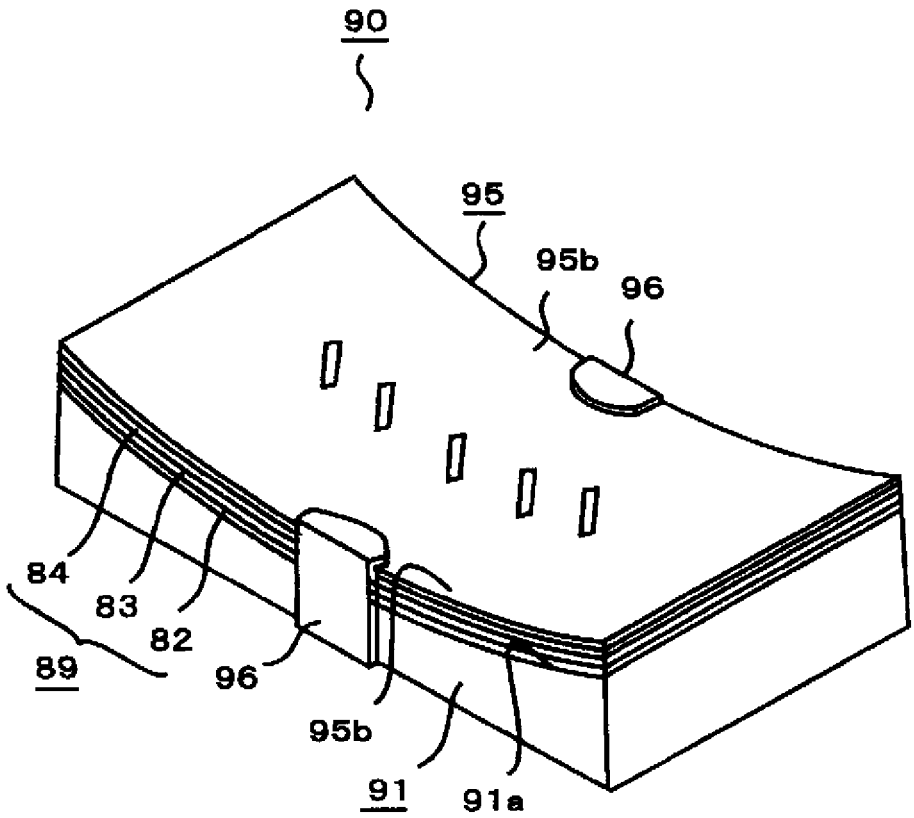
FIG. 17 is a perspective view of the curved-surface antenna according to the eighth embodiment.

FIGS. 16 and 17 show an eighth embodiment. FIG. 16 is a schematic diagram showing a process of manufacturing a curved-surface antenna, and FIG. 17 is a perspective view of the curved-surface antenna. First, with reference to FIG. 16, a method for manufacturing a curved-surface antenna 90, which is an antenna apparatus, will be described. Prior to the description, component parts shown in FIG. 16 will be described in order from bottom to top. As shown in FIG. 16F, a box-shaped base 91 has a concave portion 91*a* which has a partially cylindrical shape formed such that a central portion thereof is concave, and which has a curvature in one direction. The first lamination layer 82, the second lamination layer 83, and the third lamination layer 84 shown in FIGS. 16E, 16D, and 16C, respectively are the same as those according to the seventh embodiment shown in FIG. 14. As shown in FIG. 16F, the box-shaped base 91 has the concave portion 91*a* which is downwardly concave. As shown in FIG. 16B, a resilient plate 95 having a flat plate shape has end portions 95*a* which are opposing to each other on a short-side of the resilient plate 95, and has end portions 95*b* which are opposing to each other on a long-side thereof and clamped with clampers 96 (FIG. 17) to be described later. As shown in FIG. 16A, a pressing jig 104 has a convex pressing portion 104*a* which is downwardly convex and has a partially cylindrical shape having a curvature in one direction.

Next, a method for assembling the curved-surface antenna 90 will be described. In FIG. 16, in the same manner as the first embodiment, first, the first lamination layer 82 (FIG. 16E), the second lamination layer 83 (FIG. 16D), and the third lamination layer 84 (FIG. 16C) are laminated on the concave portion 91*a* of the base 91 (FIG. 16F), and the resilient plate 95 (FIG. 16B) is laid on the top thereof. In this state, the first lamination layer 82, the second lamination layer 83, the third lamination layer 84, and the resilient plate 95 are each in a flat plate state. Thereafter, by using the pressing jig 104 (FIG. 16A), the resilient plate 95 on the uppermost part is pressed against the base 91 until the resilient plate 95 turns into a nearly flat plate. The first lamination layer 82, the second lamination layer 83, the third lamination layer 84, and the resilient plate 95 are then each resiliently deformed into a partially cylindrical shape having a curvature in one direction. Due to a resilient force of the resilient plate 95, the first lamination layer 82, the second lamination layer 83, and the third lamination layer 84 are pressed against the concave portion 91*a* of the base 91 (FIG. 17). The end portions 95*b*, which are end portions on a long-side of the resilient plate 95, end portions of the first lamination layer 82 to the third lamination layer 84, and end portions, on the side having a curvature, of the concave portion 91*a* of the base 91 are fitted together by being press-fitted by the clampers 96, and are fixed together in an interference-fit manner. FIG. 17 shows the curved-surface antenna 90 manufactured in this manner.

In FIG. 17, the curved-surface antenna 90 is structured as follows. An antenna component part 89, which is resiliently deformed from a flat plate shape to a curved plate shape in the same manner as the seventh embodiment, is mounted on the concave portion 91*a* of the box-shaped base 91, and is pressed against and fixed to the concave portion 91*a*, which is an abutting portion of the base 91, due to the resilient force of the resilient plate 95 which is resiliently deformed into a curved plate having a partially cylindrical shape having a curvature in one direction. Accordingly, the concave portion 91*a* of the base 91, the first lamination layer 82, the second lamination layer 83, the third lamination layer 84, and the resilient plate 95 are laminated in close contact with one another. In addition, the base 91, and the first lamination layer 82, the second lamination layer 83, the third lamination layer 84, and the resilient plate 95 which are laminated on the base 91 are integrally clamped and fixed at their positions corresponding to central positions of the end portions 95*b* shown in FIG. 16 by using U-shaped clampers 96 in an interference-fit manner. Accordingly, the state where the resilient plate 95 is resiliently deformed is maintained.

Ninth Embodiment

Figures 18A, 18B, 18C, 18D, 18E, 18F:
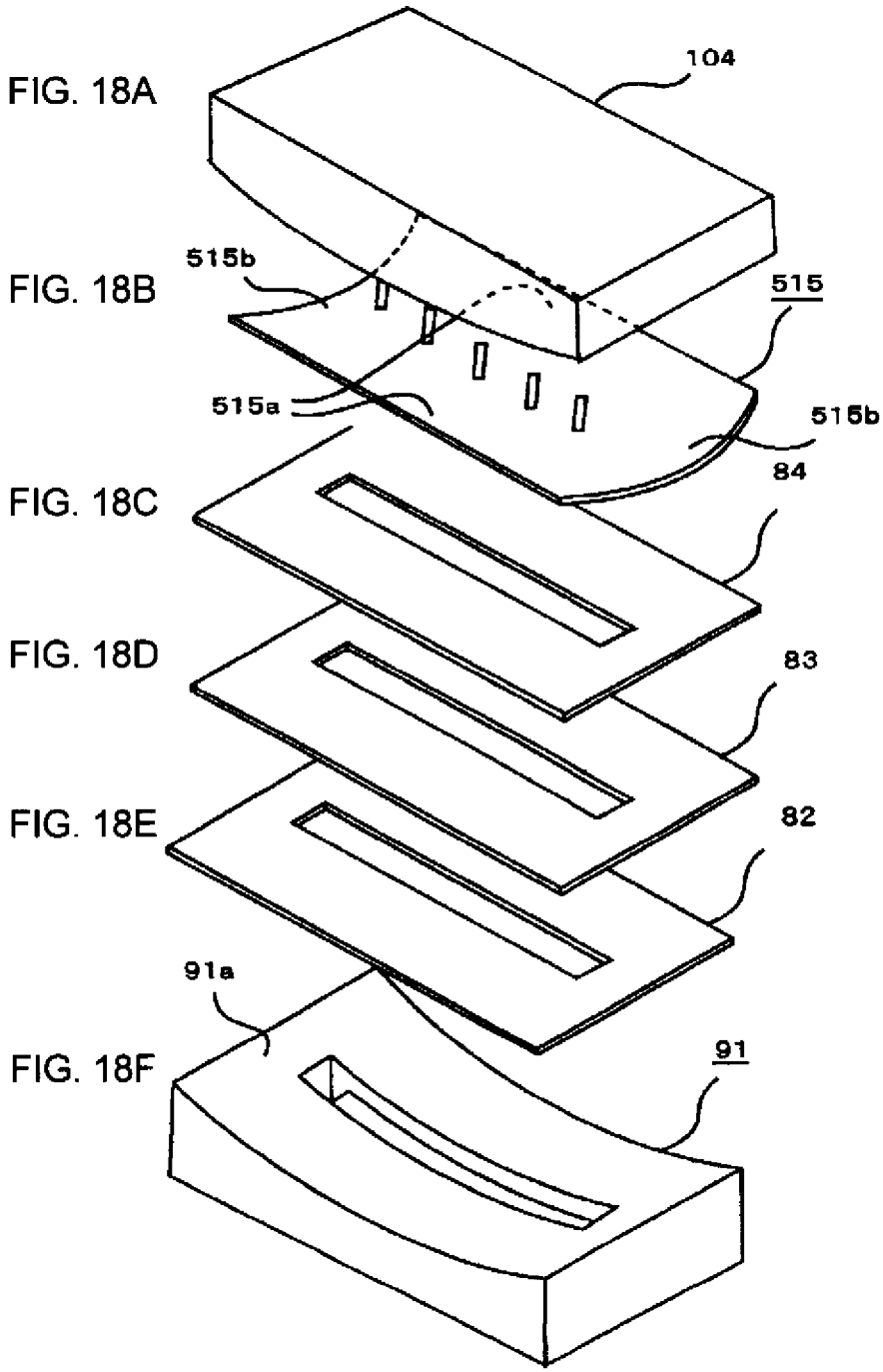
FIG. 18 is a schematic diagram illustrating a process of manufacturing a curved-surface antenna according to a ninth embodiment.
Figure 19:
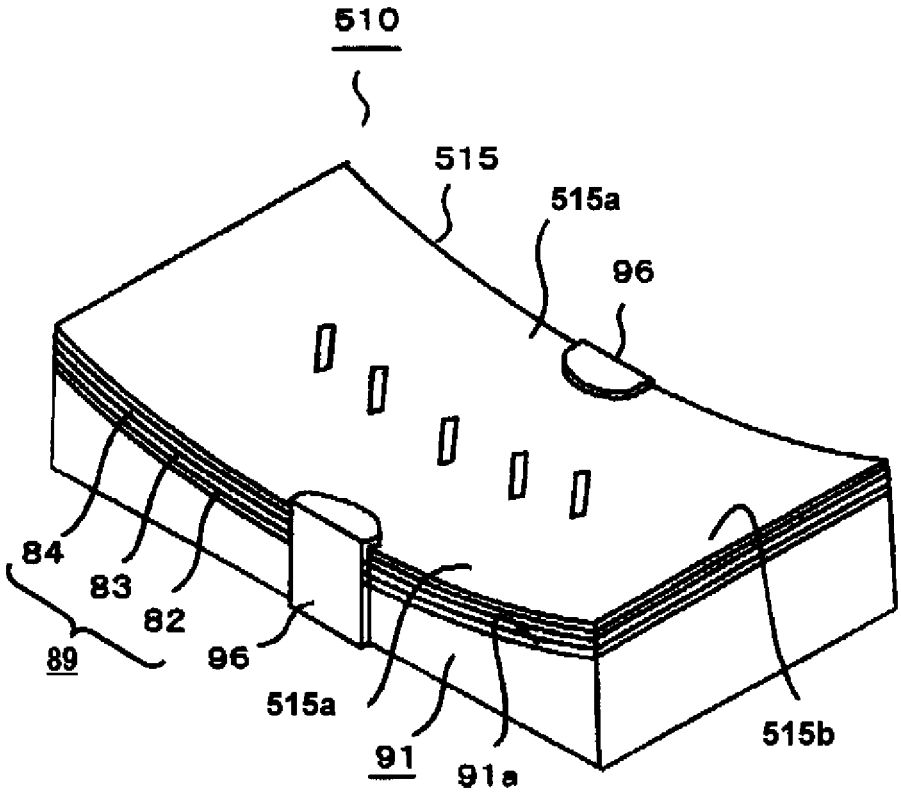
FIG. 19 is a perspective view of the curved-surface antenna according to the ninth embodiment.

FIG. 18 and FIG. 19 show a ninth embodiment. FIG. 18 is a schematic diagram showing a process of manufacturing a curved-surface antenna, and FIG. 19 is a perspective view of the curved-surface antenna. First, with reference to FIG. 19, a method for manufacturing a curved-surface antenna 510, which is an antenna apparatus, will be described. Prior to the description, component parts shown in FIG. 18 will be described in order from bottom to top. A box-shaped base 91 shown in FIG. 18F, the first lamination layer 82, the second lamination layer 83, and the third lamination layer 84 shown in FIGS. 18E, 18D, and 18C, respectively, are the same as those according to the eighth embodiment shown in FIG. 16. As shown in FIG. 18B, a resilient plate material 515 has a partially cylindrical shape having a curvature greater than a curvature of a concave portion 91*a* of the base 91, and has linear end portions 515*a* which are end portions in a circumferential direction and are to be clamped with clampers 96 (FIG. 19) described later, and also has end portions 515*b* which are opposing end portions on the side having the curvature. The resilient plate material 515 is manufactured of a stainless steel strip as a spring which is the same as that used for the resilient plate material 15 shown in FIG. 1, for example. The pressing jig 104 shown in FIG. 18A is the same as that shown in FIG. 16A.

Next, a method for assembling the curved-surface antenna 510 will be described. In FIG. 18, in the same manner as the eighth embodiment, first, the first lamination layer 82, the second lamination layer 83, and the third lamination layer 84 are mounted on the concave portion 91*a*, which is an abutting portion, of the base 91, and on the top thereof, the resilient plate material 515 (FIG. 18B) is laid. In this state, the first lamination layer 82, the second lamination layer 83, and the third lamination layer 84 are each in a flat plate state, and the resilient plate material 515 is in a partially cylindrical shape state. Thereafter, by using the pressing jig 104 (FIG. 18A), the resilient plate material 515 on the uppermost part is pressed against the base 91 until the resilient plate material 515 turns into a nearly flat plate, whereby the first lamination layer 82, the second lamination layer 83, the third lamination layer 84, and the resilient plate material 515 are resiliently deformed into a partially cylindrical shape having a curvature different from an original curvature of the resilient plate material 515. Due to the resilient force of the resilient plate material 515, the first lamination layer 82, the second lamination layer 83, and the third lamination layer 84 are pressed against the concave portion 91*a* of the base 91 (FIG. 19). The end portions 515*a* of the resilient plate material 515 in its circumferential direction, end portions of the first lamination layer 82 to the third lamination layer 84 on their long side, and end portions, on the side having a curvature, of the concave portion 91*a* of the base 91 are fitted together by being press-fitted by clampers 96, and are fixed together in an interference-fit manner. FIG. 19 shows the curved-surface antenna 510 manufactured in this manner.

In FIG. 19, the curved-surface antenna 510 is structured as follows. The first lamination layer 82, which forms an antenna component part and which is resiliently deformed from a flat plate shape to a curved plate shape in the same manner as the eighth embodiment, abuts against the concave portion 91*a* of the box-shaped base 91. On the first lamination layer 82, the second lamination layer 83, and the third lamination layer 84, which also forms the antenna component part and which is resiliently deformed from the flat plate shape to the curved plate shape, and the resilient plate material 515, which is resiliently deformed and thus has a changed curvature, are laminated in close contact with one another. Due to a resilient force of the resilient plate material 515 which has been resiliently deformed into a different partially cylindrical shape, nearly entire surfaces of the first lamination layer 82, the second lamination layer 83, and the third lamination layer 84 are pressed against the concave portion 91*a* of the base 91. In addition, the base 91, and the first lamination layer 82, the second lamination layer 83, the third lamination layer 84, and the resilient plate material 515 which are laminated on the base 91, are integrally clamped and fixed, at their positions corresponding to central portions of the end portions 515*a* extending in a left-right direction in FIG. 19, with U-shaped clampers 96 in an interference-fit manner.

According to the above-described embodiments, nearly the entire surface of the antenna component part is pressed by using the resilient force generated by resiliently deforming the resilient plate material 15, 45, 515, or 75, or the resilient plate 95 which is a resilient plate having sufficient resilience. Thus, it is possible to press the antenna component part with a simple structure, and also possible to attain a planar antenna which has a reduced number of parts and which is easily manufacturable.

In the above embodiments, the first lamination layer 82 to the third lamination layer 84, which form the antenna component part, are laminated, and thereby the antenna apparatus is formed. As a waveguide structured by laminating a plate-shaped antenna component part, there are a waveguide tube, a coaxial cable, a planar waveguide, and the like. As antennas including these waveguides, there are a waveguide feed type antenna, a coaxial cable feed type antenna, an antenna using a planar circuit, a slot antenna, and the like. In any one of the waveguides structured by laminating the plate-shaped antenna component part, or in any one of the antennas, the same effects as above can be exerted when at least one of lamination layers, which is furthest from the base is formed of a resilient plate material or a flat plate having a sufficient resilience.

Further, combination between the resilient plate material 15, 45, 75, or 515, or the resilient plate 85 or 95 and the base 11, 21, 61, 81, or 91 is not limited depending on the above embodiments, but various combination may be available. Further, each of the first lamination layer 12, the second lamination layer 13, and the third lamination layer 14 is not limited to a flat plate, but may have a curvature or curvatures in one direction or in two directions on an xy-plane coordinate system. In FIG. 1B for the first embodiment, the resilient plate material 15 satisfying formula (1) is most preferable in that the first lamination layer 12 to the third lamination layer 14 are uniformly pressed against the base 11. However, the uniform pressing is not the sine qua non of the resilient plate material, and the resilient plate material is not limited to that satisfying formula (1).

As described above, according to the present invention, the waveguides and the antenna aperture area are held in close contact with each other in a secured manner, and thus it is possible to achieve uniformity in the excitation phase in the waveguides and on the antenna aperture area. Further, it is possible to attain a planar antenna which has a reduced number of parts and which is easily manufacturable.

Various modifications and alterations of this invention will be apparent to those skilled in the art without departing from the scope and spirit of this invention, and it should be understood that this is not limited to illustrative embodiments set forth herein.

What is claimed is:

1. An antenna apparatus comprising:

a base;

an antenna component part; and a pressing plate, wherein the antenna component part includes a plurality of planar antenna lamination layers which are laminated one directly on top of another, the pressing plate formed of a resilient material, and the pressing plate is a partially cylindrical member of a partially cylindrical shape having a curvature in one direction such that end portion of the pressing plate faces away from the base prior to assembly, the pressing plate is arranged such that the antenna component part is interposed between the pressing plate and the base, and a fixing member, being a single component, disposed in an upright position on a top surface of the base, forming a straight plate extending from the base, wherein the fixing member is configured to be formed into a caulking member provided on the base and bent from said upright position into a L-shape position having, a first member perpendicular to a second member, during assembly, as a result of deformation of the straight plate extending from the base, and wherein the caulking member is configured to substantially cover and press the end portions of the pressing plate towards the base, so that the pressing plate is resiliently deformed to a planar shape and that the antenna component part is pressed against the base due to a resilient force generated by the deformation after assembly, wherein the end portions of the pressing plate and end portions of the antenna component part are caulked by caulking member, being in contact with at least one of the first member and the second member of the L-shaped caulking member, and are fixed onto the base, and wherein the end portion of the plate are sandwiched between a portion of the caulking member and the base after assembly.

2. The antenna apparatus according to claim 1, wherein the pressing plate is a curved plate having curvatures in two directions which are perpendicular to each other.

3. The antenna apparatus according to claim 1, wherein the base has an abutting portion of a flat plate shape, and the pressing plate is arranged such that the antenna component part is interposed between the pressing plate and the abutting portion of the base, and is resiliently deformed into a nearly flat plate shape.

4. The antenna apparatus according to claim 1, wherein the base has an abutting portion of a partially cylindrical shape having a curvature in one direction, and the pressing plate is a flat resilient plate, and is arranged such that the antenna component part is interposed between the pressing plate and an abutting portion of the base, and is resiliently deformed into a partially cylindrical shape.

5. The antenna apparatus according to claim 1, wherein the base has an abutting portion of a partial concave shape having a curvature in one direction, and the pressing plate is a flat resilient plate or a partially cylindrical member of a partially cylindrical shape having a curvature in one direction, and is arranged such that the antenna component part is interposed between the pressing plate and the abutting portion of the base, and is resiliently deformed into a partially cylindrical shape.

6. The antenna apparatus according to claim 1, wherein the fixing member is a locking member whose lower end is bent and whose upper side has a slit, the end portions of the pressing plate are fitted into the slit, and the bent lower end is engaged with end portions of the base, and is fixed to the base.

7. The antenna apparatus according to claim 1, wherein the fixing member includes a fixing frame which includes a pressing portion, a connecting portion for connection with the pressing portion, and fitting pins arranged on the pressing portion, and the base has arranged thereon fitting holes fitted with the fitting pins.

8. The antenna apparatus according to claim 1, wherein the fixing member is formed of a gripping member whose cross-section has a U-shape, and end portions of the base, end portions of the antenna component part, and the end portions of the pressing plate are gripped by the gripping member such that the pressing plate is pressed against the base.

9. The antenna apparatus according to claim 1, wherein the fixing member is formed of an end weld portion which includes the end portions of the pressing plate, end portions of the antenna component part, and end portions of the base having been welded and fixed together.

10. The antenna apparatus according to claim 1, wherein the end portions of the pressing plate have a length and are formed on opposite outermost ends of the pressing plate, wherein the fixing member contacts the pressing plate substantially along the lengths to press the end portions towards the base.

11. The antenna apparatus according to claim 1, wherein the pressing plate has a shape consisting substantially of a cylindrical shell.

12. A method for manufacturing an antenna apparatus, comprising:

a pressing plate arranging step of arranging a pressing plate having a curvature in one direction with end portions facing away from the base, and such that an antenna component part, in which a plurality of planar antenna lamination layers are laminated one directly on top of another, is interposed between the pressing plate and a base; and a pressing plate fixing step of pressing the antenna component part against the base by using a resilient force generated by resiliently deforming the pressing plate, and substantially covering and pressing the end portions of the pressing plate towards the base by using a fixing member, being a single component, which substantially covers the end portions, so as to press against and fix to the base the antenna component part by using a resilient force generated, after assembly, by the resiliently deformed pressing plate, a fixing member step wherein the fixing member is configured to be formed into a caulking member provided on the base and bent from said upright position into a L-shape position having, a first member perpendicular to a second member, and wherein the end portions of the pressing plate and end portions of the antenna component part are caulked by the caulking member, being in contact with at least one of the first member and the second member of the L-shaped caulking member, and are fixed onto the base, and wherein the end portions of the plate are sandwiched between a portion of the fixing member and the base after assembly.

13. The method for manufacturing the antenna apparatus according to claim 12, wherein the pressing plate fixing step includes a jig pressing step of pressing and resiliently deforming the pressing plate by using a pressing jig.

14. The method for manufacturing the antenna apparatus according to claim 12, wherein the end portions of the pressing plate have a length and are formed on opposite outermost ends of the pressing plate, and the fixing member contacts the pressing plate substantially along the lengths to press the end portions towards the base.

* * * * *